US009944877B2

(12) United States Patent
Gao et al.

(10) Patent No.: US 9,944,877 B2
(45) Date of Patent: *Apr. 17, 2018

(54) COMPOSITION AND METHOD FOR PREVENTING OR REDUCING ENGINE KNOCK AND PRE-IGNITION IN HIGH COMPRESSION SPARK IGNITION ENGINES

(71) Applicant: ExxonMobil Research and Engineering Company, Annandale, NJ (US)

(72) Inventors: Jason Z. Gao, Rose Valley, PA (US); Eugine Choi, Marlton, NJ (US); Luca Salvi, Philadelphia, PA (US); Matthew W. Boland, Philadelphia, PA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/835,847

(22) Filed: Aug. 26, 2015

(65) Prior Publication Data

US 2016/0075967 A1 Mar. 17, 2016

Related U.S. Application Data

(60) Provisional application No. 62/051,545, filed on Sep. 17, 2014.

(51) Int. Cl.
*C10M 169/04* (2006.01)
*C10M 105/34* (2006.01)
(Continued)

(52) U.S. Cl.
CPC ..... *C10M 105/06* (2013.01); *C10M 101/02* (2013.01); *C10M 105/00* (2013.01);
(Continued)

(58) Field of Classification Search
CPC ..... C10M 2219/044; C10M 2207/281; C10M 2207/123
(Continued)

(56) References Cited

U.S. PATENT DOCUMENTS 1,815,022 A 7/1931 Davis
2,015,748 A 10/1935 Frolich
(Continued)

FOREIGN PATENT DOCUMENTS

CA 1094044 A1 1/1981
DE 3835348 A1 8/1994
(Continued)

OTHER PUBLICATIONS

Pending U.S. Appl. No. 14/681,251, filed Apr. 8, 2015.
(Continued)

*Primary Examiner* — Vishal Vasisth
(74) *Attorney, Agent, or Firm* — Robert A. Migliorini

(57) ABSTRACT

A method for preventing or reducing engine knock or pre-ignition in a high compression spark ignition engine lubricated with a lubricating oil by using as the lubricating oil a formulated oil. The formulated oil has a composition that contains at least one branched hydrocarbon having at least about 25% of the carbons in the form of methyl groups, or at least one polyol ester of at least one branched mono-carboxylic acid. A lubricating engine oil having a composition that contains at least one branched hydrocarbon having at least about 25% of the carbons in the form of methyl groups, or at least one polyol ester of at least one branched mono-carboxylic acid. The lubricating engine oils are useful as passenger vehicle engine oil (PVEO) products.

24 Claims, 22 Drawing Sheets

| | Relative Ignition Delay (Normalized to Isooctane) | | | | |
|---|---|---|---|---|---|
| Chemical Name | Pure Isooctane | 1% in Isooctane | 5% in Isooctane | 10% in Isooctane | 15% in Isooctane |
| Isooctane | 1.0000 | | | | |
| Base Oil 1 | | 1.0271 | 1.0380 | 1.0436 | 1.0487 |
| Base Oil 2 | | 1.0221 | 0.9765 | 0.9419 | 0.9134 |
| Base Oil 3 | | 1.0033 | 0.9298 | 0.8668 | 0.8051 |
| Base Oil 4 | | 1.0207 | 0.9914 | 0.9334 | 0.8855 |
| Base Oil 5 | | 0.8983 | 0.7901 | 0.7717 | |
| Base Oil 6 | | 0.8974 | 0.8450 | 0.8552 | 0.8706 |
| Base Oil 7 | | 0.8771 | 0.9508 | 1.0367 | 1.0710 |
| Base Oil 8 | | 1.0444 | 0.9203 | 0.8423 | 0.8492 |
| Base Oil 9 | | 0.9809 | 0.9048 | 0.8380 | 0.7938 |
| Base Oil 10 | | 0.9629 | 0.8547 | 0.8086 | 0.7697 |
| Base Oil 11 | | 0.9847 | 0.8776 | 0.7885 | 0.7401 |
| Base Oil 12 | | 0.9635 | 0.8528 | 0.7698 | 0.7017 |

(51) Int. Cl.

| | |
|---|---|
| ***C07C 55/02*** | (2006.01) |
| ***C10M 105/06*** | (2006.01) |
| ***C10M 105/38*** | (2006.01) |
| ***C10M 107/08*** | (2006.01) |
| ***C10M 171/00*** | (2006.01) |
| ***C10M 105/00*** | (2006.01) |
| ***C10M 101/02*** | (2006.01) |
| ***C10M 105/04*** | (2006.01) |
| ***C10M 105/36*** | (2006.01) |
| ***C10M 105/40*** | (2006.01) |
| ***C10M 107/02*** | (2006.01) |
| ***C10M 107/10*** | (2006.01) |
| ***C10M 107/34*** | (2006.01) |
| ***C10M 111/02*** | (2006.01) |
| ***C10M 111/04*** | (2006.01) |

(52) U.S. Cl.

CPC ..... *C10M 105/04* (2013.01); *C10M 105/36* (2013.01); *C10M 105/38* (2013.01); *C10M 105/40* (2013.01); *C10M 107/02* (2013.01); *C10M 107/08* (2013.01); *C10M 107/10* (2013.01); *C10M 107/34* (2013.01); *C10M 111/02* (2013.01); *C10M 111/04* (2013.01); *C10M 171/00* (2013.01); *C10M 2203/0206* (2013.01); *C10M 2203/1006* (2013.01); *C10M 2203/1025* (2013.01); *C10M 2205/026* (2013.01); *C10M 2205/0265* (2013.01); *C10M 2205/0285* (2013.01); *C10M 2207/026* (2013.01); *C10M 2207/282* (2013.01); *C10M 2207/283* (2013.01); *C10M 2207/2815* (2013.01); *C10M 2207/2825* (2013.01); *C10M 2207/2835* (2013.01); *C10M 2209/084* (2013.01); *C10M 2209/105* (2013.01); *C10M 2215/28* (2013.01); *C10M 2219/068* (2013.01); *C10M 2223/045* (2013.01); *C10N 2210/02* (2013.01); *C10N 2210/06* (2013.01); *C10N 2220/028* (2013.01); *C10N 2230/00* (2013.01); *C10N 2230/02* (2013.01); *C10N 2230/40* (2013.01); *C10N 2230/42* (2013.01); *C10N 2230/44* (2013.01); *C10N 2230/45* (2013.01); *C10N 2230/76* (2013.01); *C10N 2240/10* (2013.01); *C10N 2240/104* (2013.01); *C10N 2260/02* (2013.01)

(58) Field of Classification Search

USPC ..... 508/409, 463, 506

See application file for complete search history.

(56) References Cited

U.S. PATENT DOCUMENTS

| | | | |
|---|---|---|---|
| 2,100,993 | A | 11/1937 | Bruson |
| 2,191,498 | A | 2/1940 | Reiff |
| 2,387,501 | A | 10/1945 | Dietrich |
| 2,655,479 | A | 10/1953 | Munday et al. |
| 2,666,746 | A | 1/1954 | Munday et al. |
| 2,721,877 | A | 10/1955 | Popkin et al. |
| 2,721,878 | A | 10/1955 | Popkin |
| 2,817,693 | A | 12/1957 | Koome et al. |
| 3,036,003 | A | 5/1962 | Verdol |
| 3,087,936 | A | 4/1963 | Le Suer |
| 3,172,892 | A | 3/1965 | Le Suer et al. |
| 3,200,107 | A | 8/1965 | Le Suer |
| 3,215,707 | A | 11/1965 | Rense |
| 3,219,666 | A | 11/1965 | Norman et al. |
| 3,250,715 | A | 5/1966 | Wyman |
| 3,254,025 | A | 5/1966 | Le Suer |
| 3,272,746 | A | 9/1966 | Le Suer et al. |
| 3,275,554 | A | 9/1966 | Wagenaar |
| 3,316,177 | A | 4/1967 | Dorer, Jr. |
| 3,322,670 | A | 5/1967 | Burt et al. |
| 3,329,658 | A | 7/1967 | Fields |
| 3,341,542 | A | 9/1967 | Le Suer et al. |
| 3,382,291 | A | 5/1968 | Brennan |
| 3,413,347 | A | 11/1968 | Worrel |
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | van der Voort et al. |
| 3,454,607 | A | 7/1969 | Le Suer et al. |
| 3,519,565 | A | 7/1970 | Coleman |
| 3,541,012 | A | 11/1970 | Stuebe |
| 3,563,715 | A | 2/1971 | Richardson et al. |
| 3,565,804 | A | 2/1971 | Honnen et al. |
| 3,595,791 | A | 7/1971 | Cohen |
| 3,630,904 | A | 12/1971 | Musser et al. |
| 3,632,511 | A | 1/1972 | Liao |
| 3,652,616 | A | 3/1972 | Watson et al. |
| 3,666,730 | A | 5/1972 | Coleman |
| 3,687,849 | A | 8/1972 | Abbott |
| 3,697,574 | A | 10/1972 | Piasek et al. |
| 3,702,300 | A | 11/1972 | Coleman |
| 3,703,536 | A | 11/1972 | Piasek et al. |
| 3,704,308 | A | 11/1972 | Piasek et al. |
| 3,725,277 | A | 4/1973 | Worrel |
| 3,725,480 | A | 4/1973 | Traise et al. |
| 3,726,882 | A | 4/1973 | Traise et al. |
| 3,742,082 | A | 6/1973 | Brennan |
| 3,751,365 | A | 8/1973 | Piasek et al. |
| 3,755,433 | A | 8/1973 | Miller et al. |
| 3,756,953 | A | 9/1973 | Piasek et al. |
| 3,769,363 | A | 10/1973 | Brennan |
| 3,787,374 | A | 1/1974 | Adams |
| 3,798,165 | A | 3/1974 | Piasek et al. |
| 3,803,039 | A | 4/1974 | Piasek et al. |
| 3,822,209 | A | 7/1974 | Knapp et al. |
| 3,876,720 | A | 4/1975 | Heilman et al. |
| 3,948,800 | A | 4/1976 | Meinhardt |
| 4,100,082 | A | 7/1978 | Clason et al. |
| 4,149,178 | A | 4/1979 | Estes |
| 4,218,330 | A | 8/1980 | Shubkin |
| 4,234,435 | A | 11/1980 | Meinhardt et al. |
| 4,239,930 | A | 12/1980 | Allphin et al. |
| 4,367,352 | A | 1/1983 | Watts, Jr. et al. |
| 4,413,156 | A | 11/1983 | Watts, Jr. et al. |
| 4,426,305 | A | 1/1984 | Malec |
| 4,434,408 | A | 2/1984 | Baba et al. |
| 4,454,059 | A | 6/1984 | Pindar et al. |
| 4,594,172 | A | 6/1986 | Sie |
| 4,602,919 | A | 7/1986 | Jessup et al. |
| 4,767,551 | A | 8/1988 | Hunt et al. |
| 4,798,684 | A | 1/1989 | Salomon |
| 4,827,064 | A | 5/1989 | Wu |
| 4,827,073 | A | 5/1989 | Wu |
| 4,897,178 | A | 1/1990 | Best et al. |
| 4,910,355 | A | 3/1990 | Shubkin et al. |
| 4,921,594 | A | 5/1990 | Miller |
| 4,943,672 | A | 7/1990 | Hamner et al. |
| 4,956,122 | A | 9/1990 | Watts et al. |
| 4,975,177 | A | 12/1990 | Garwood et al. |
| 5,068,487 | A | 11/1991 | Theriot |
| 5,075,269 | A | 12/1991 | Degnan et al. |
| 5,084,197 | A | 1/1992 | Galic et al. |
| 5,562,867 | A | 10/1996 | Tiffany, III et al. |
| 5,705,458 | A | 1/1998 | Roby et al. |
| 6,034,039 | A | 3/2000 | Gomes et al. |
| 6,080,301 | A | 6/2000 | Berlowitz et al. |
| 6,090,989 | A | 7/2000 | Trewella et al. |
| 6,165,949 | A | 12/2000 | Berlowitz et al. |
| 6,323,164 | B1 | 11/2001 | Liesen et al. |
| 6,468,319 | B1 | 10/2002 | Yeh et al. |
| 6,846,782 | B2 | 1/2005 | Calder |
| 7,262,155 | B2 | 8/2007 | Ryan, III et al. |
| 7,691,792 | B1 * | 4/2010 | Fisher ..... C07C 13/18 508/110 |
| 7,704,930 | B2 | 4/2010 | Deckman et al. |
| 7,828,862 | B2 | 11/2010 | Leung |
| 8,048,833 | B2 | 11/2011 | Habeeb et al. |

(56) References Cited

U.S. PATENT DOCUMENTS

| | | | | |
|---|---|---|---|---|
| 8,129,320 | B2 | 3/2012 | Amann et al. | |
| 8,349,032 | B2 | 1/2013 | Narayan et al. | |
| 2001/0007851 | A1 | 7/2001 | Gao | |
| 2009/0241882 | A1* | 10/2009 | Brunner | C10L 1/1633 123/1 A |
| 2009/0325831 | A1* | 12/2009 | Mathur | C08F 255/00 508/259 |
| 2011/0059878 | A1 | 3/2011 | Amann et al. | |

FOREIGN PATENT DOCUMENTS

| | | | |
|---|---|---|---|
| EP | 0464546 | A1 | 1/1992 |
| EP | 0464547 | A1 | 1/1992 |
| EP | 0471071 | B1 | 8/1995 |
| GB | 1001351 | A | 8/1965 |
| GB | 1350257 | A | 4/1974 |
| GB | 1390359 | A | 4/1975 |
| GB | 1429494 | A | 3/1976 |
| GB | 1440230 | A | 6/1976 |
| WO | 1994/05745 | A1 | 3/1994 |
| WO | 1994/17160 | A1 | 8/1994 |
| WO | 00/29521 | A1 | 5/2000 |
| WO | 2015/171292 | A1 | 11/2015 |

OTHER PUBLICATIONS

Ren, Yi et al., "Combustion and Emission Characteristics of a Direct-Injection Diesel Engine Fueled with Diesel-Diethyl Adipate Blends," Energy & Fuels, 2007, vol. 21, pp. 1474-1482.

Sullivan, M.V. et al., "Flammability of the Higher Boiling Liquids and Their Mists," Industrial and Engineering Chemistry, 1947, vol. 39, Issue 12, pp. 1607-1614.

Cato, Ralph J. et al., "Hot Gas Ignition Temperatures of Hydrocarbon Fuel Vapor-Air Mixtures," American Chemical Society, Division of Fuel Chemistry, 1965, vol. 9, Issue 4, pp. 28-42.

Kuchta, Joseph M. et al., "Hot Gas Ignition Temperatures of Hydrocarbon Fuel Vapor-Air Mixtures," Bureau of Mines Report of Investigations, 1966, No. 6857

Kuchta, Joseph M. et al., "Hot Surface Ignition Temperatures of Hydrocarbon Fuel Vapor-Air Mixtures," Journal of Chemical and Engineering Data, 1965, vol. 10, Issue 3, pp. 282-288.

Serdari, Aikaterini et al., "Impact of Esters of Mono- and Dicarboxylic Acids on Diesel Fuel Quality," Industrial & Engineering Chemistry Research, 1999, vol. 38, Issue 9, pp. 3543-3548.

The International Search Report and Written Opinian of PCT/US2015/047184 dated Dec. 14, 2015.

The International Search Report and Written Opinion of PCT/US2015/026607 dated Jul. 17, 2015.

* cited by examiner

Fig. 1

| Chemical Name | Relative Ignition Delay (Normalized to Isooctane) | | | | |
|---|---|---|---|---|---|
| | Pure Isooctane | 1% in Isooctane | 5% in Isooctane | 10% in Isooctane | 15% in Isooctane |
| Isooctane | 1.0000 | | | | |
| Base Oil 1 | | 1.0271 | 1.0380 | 1.0436 | 1.0487 |
| Base Oil 2 | | 1.0221 | 0.9765 | 0.9419 | 0.9134 |
| Base Oil 3 | | 1.0033 | 0.9298 | 0.8668 | 0.8051 |
| Base Oil 4 | | 1.0207 | 0.9914 | 0.9334 | 0.8855 |
| Base Oil 5 | | 0.8983 | 0.7901 | 0.7717 | |
| Base Oil 6 | | 0.8974 | 0.8450 | 0.8552 | 0.8706 |
| Base Oil 7 | | 0.8771 | 0.9508 | 1.0367 | 1.0710 |
| Base Oil 8 | | 1.0444 | 0.9203 | 0.8423 | 0.8492 |
| Base Oil 9 | | 0.9809 | 0.9048 | 0.8380 | 0.7938 |
| Base Oil 10 | | 0.9629 | 0.8547 | 0.8086 | 0.7697 |
| Base Oil 11 | | 0.9847 | 0.8776 | 0.7885 | 0.7401 |
| Base Oil 12 | | 0.9635 | 0.8528 | 0.7698 | 0.7017 |

Fig. 1 (Cont.)

| Chemical Name | Relative Ignition Delay (Normalized to Isooctane) | | | | |
|---|---|---|---|---|---|
| | Pure Isooctane | 1% in Isooctane | 5% in Isooctane | 10% in Isooctane | 15% in Isooctane |
| Isooctane | 1.0000 | | | | |
| Base Oil 13 | | 0.9875 | 0.8553 | 0.7555 | 0.6928 |
| Base Oil 14 | | 0.9460 | 0.8400 | 0.7653 | 0.7151 |
| Base Oil 15 | | 0.9769 | 0.8540 | 0.7458 | 0.6670 |
| Base Oil 16 | | 0.9668 | 0.8709 | 0.7618 | 0.6806 |
| Base Oil 17 | | 0.9807 | 0.8492 | 0.7458 | 0.6778 |
| Base Oil 18 | | 0.9766 | 0.8243 | 0.7157 | 0.6549 |
| Base Oil 19 | | 0.9797 | 0.7892 | 0.6678 | 0.6055 |
| Base Oil 20 | | 0.8287 | 0.7536 | 0.7136 | 0.6602 |
| Base Oil 21 | | 0.9422 | 0.7857 | 0.6681 | 0.5935 |
| Base Oil 22 | | 0.9631 | 0.7394 | 0.6576 | 0.5702 |
| Base Oil 23 | | 0.9554 | 0.7675 | 0.6521 | 0.5702 |
| Base Oil 24 | | 0.9573 | 0.7259 | 0.5829 | 0.5087 |

Fig. 1 (Cont.)

| Chemical Name | Relative Ignition Delay (Normalized to Isooctane) | | | | |
|---|---|---|---|---|---|
| | Pure Isooctane | 1% in Isooctane | 5% in Isooctane | 10% in Isooctane | 15% in Isooctane |
| Isooctane | 1.0000 | | | | |
| Base Oil 25 | | 0.9295 | 0.7569 | 0.6370 | |
| Base Oil 26 | | 0.9265 | 0.7237 | 0.5956 | 0.5189 |
| Base Oil 27 | | 0.9282 | 0.7148 | 0.5794 | 0.5074 |
| Base Oil 28 | | 0.9160 | 0.7048 | 0.5683 | 0.4958 |
| Base Oil 29 | | 0.8666 | 0.6502 | 0.5242 | 0.4559 |
| Base Oil 30 | | 0.8960 | 0.6376 | 0.4989 | 0.4359 |
| Base Oil 31 | | 0.8406 | 0.6033 | 0.4860 | 0.4217 |
| Base Oil 32 | | 0.9156 | 0.6906 | 0.5461 | 0.4754 |
| Base Oil 33 | | 0.9164 | 0.6916 | 0.5526 | 0.4805 |
| Base Oil 34 | | 0.8396 | 0.5402 | 0.4208 | 0.3566 |
| Base Oil 35 | | 0.7342 | 0.4758 | 0.3845 | 0.3298 |
| Base Oil 36 | | 0.6460 | 0.4569 | 0.3750 | 0.3225 |

Fig. 2

| Chemical Name | Relative Combustion Delay (Normalized to Isooctane) | | | | |
|---|---|---|---|---|---|
| | Pure Isooctane | 1% in Isooctane | 5% in Isooctane | 10% in Isooctane | 15% in Isooctane |
| Isooctane | 1.0000 | | | | |
| Base Oil 1 | | 1.0052 | 0.9751 | 0.9166 | 0.8589 |
| Base Oil 2 | | 1.0207 | 0.9842 | 0.9355 | 0.8982 |
| Base Oil 3 | | 1.0281 | 0.9899 | 0.9417 | 0.8764 |
| Base Oil 4 | | 1.0025 | 0.9752 | 0.9060 | 0.8574 |
| Base Oil 5 | | 0.9743 | 0.8762 | 0.3804 | |
| Base Oil 6 | | 0.9845 | 0.9772 | 0.9825 | 0.9843 |
| Base Oil 7 | | 0.9776 | 0.9905 | 0.9589 | 0.9158 |
| Base Oil 8 | | 1.0292 | 0.8645 | 0.7594 | 0.7703 |
| Base Oil 9 | | 0.9947 | 0.8804 | 0.7656 | 0.6755 |
| Base Oil 10 | | 1.0067 | 0.9511 | 0.9196 | 0.8792 |
| Base Oil 11 | | 0.9703 | 0.7880 | 0.6145 | 0.4880 |
| Base Oil 12 | | 0.9900 | 0.8577 | 0.7161 | 0.6097 |

Fig. 2 (Cont.)

| Chemical Name | Relative Combustion Delay (Normalized to Isooctane) | | | | |
|---|---|---|---|---|---|
| | Pure Isooctane | 1% in Isooctane | 5% in Isooctane | 10% in Isooctane | 15% in Isooctane |
| Isooctane | 1.0000 | | | | |
| Base Oil 13 | | 0.9862 | 0.8507 | 0.7153 | 0.6058 |
| Base Oil 14 | | 0.9628 | 0.8453 | 0.7411 | 0.6625 |
| Base Oil 15 | | 1.0031 | 0.8835 | 0.7727 | 0.6671 |
| Base Oil 16 | | 0.9858 | 0.9016 | 0.7887 | 0.7074 |
| Base Oil 17 | | 0.9781 | 0.8116 | 0.6549 | 0.5406 |
| Base Oil 18 | | 0.9820 | 0.8575 | 0.7382 | 0.6451 |
| Base Oil 19 | | 0.9794 | 0.8101 | 0.6733 | 0.5758 |
| Base Oil 20 | | 0.7320 | 0.6155 | 0.5444 | 0.4434 |
| Base Oil 21 | | 0.9449 | 0.7329 | 0.5646 | 0.4348 |
| Base Oil 22 | | 0.9515 | 0.6650 | 0.5371 | 0.3708 |
| Base Oil 23 | | 0.9444 | 0.6804 | 0.4596 | 0.3188 |
| Base Oil 24 | | 0.9300 | 0.7043 | 0.5064 | |

Fig. 2 (Cont.)

| Chemical Name | Relative Combustion Delay (Normalized to Isooctane) | | | | |
|---|---|---|---|---|---|
| | Pure Isooctane | 1% in Isooctane | 5% in Isooctane | 10% in Isooctane | 15% in Isooctane |
| Isooctane | 1.0000 | | | | |
| Base Oil 25 | | 0.94881 | 0.70959 | 0.52401 | 0.39666 |
| Base Oil 26 | | 0.9405 | 0.7018 | 0.5221 | 0.3849 |
| Base Oil 27 | | 0.9077 | 0.6506 | 0.4509 | 0.2984 |
| Base Oil 28 | | 0.9204 | 0.6317 | 0.4215 | 0.2753 |
| Base Oil 29 | | 0.9094 | 0.6084 | 0.4005 | 0.2546 |
| Base Oil 30 | | 0.9021 | 0.5764 | 0.3455 | 0.2094 |
| Base Oil 31 | | 0.8845 | 0.5990 | 0.3931 | 0.2588 |
| Base Oil 32 | | 0.9092 | 0.6240 | 0.3935 | 0.2592 |
| Base Oil 33 | | 0.9121 | 0.6385 | 0.4154 | 0.2777 |
| Base Oil 34 | | 0.9131 | 0.6621 | 0.4752 | 0.3299 |
| Base Oil 35 | | 0.9038 | 0.6984 | 0.5025 | 0.3449 |
| Base Oil 36 | | 0.8876 | 0.6851 | 0.4836 | 0.3257 |

Fig. 3

| Chemical Name | Observation | Relative Ignition Delay (Normalized to Isooctane) | | | | |
|---|---|---|---|---|---|---|
| | | Pure Isooctane | 1% in Isooctane | 5% in Isooctane | 10% in Isooctane | 15% in Isooctane |
| Isooctane | | 1.0000 | | | | |
| | | | | | | |
| Base Oil 1/Base Oil 4 (80/20) | Slightly Haze | | 1.0107 | 0.9944 | 0.9926 | 0.9854 |
| Base Oil 1/Base Oil 4 (60/40) | Clear | | 1.0109 | 0.9894 | 0.9678 | 0.9499 |
| Base Oil 1/Base Oil 4 (40/60) | Clear | | 1.0127 | 0.9840 | 0.9551 | 0.9193 |
| Base Oil 1/Base Oil 4 (20/80) | Clear | | 1.0134 | 0.9858 | 0.9379 | 0.8976 |
| | | | | | | |
| Base Oil 1/Base Oil 8 (80/20) | Clear | | 1.0135 | 1.0084 | 1.0027 | 0.9997 |
| Base Oil 1/Base Oil 8 (60/40) | Clear | | 1.0147 | 1.0092 | 0.9990 | 0.9918 |
| Base Oil 1/Base Oil 8 (40/60) | Clear | | 0.9977 | 0.9946 | 0.9960 | 0.9946 |
| Base Oil 1/Base Oil 8 (20/80) | Clear | | 1.0001 | 0.9921 | 0.9953 | 0.9894 |

Fig. 4

| Chemical Name | Observation | Relative Combustion Delay (Normalized to Isooctane) | | | | |
|---|---|---|---|---|---|---|
| | | Pure Isooctane | 1% in Isooctane | 5% in Isooctane | 10% in Isooctane | 15% in Isooctane |
| Isooctane | | 1.0000 | | | | |
| | | | | | | |
| Base Oil 1/Base Oil 4 (80/20) | Slightly Haze | | 0.9869 | 0.9381 | 0.8859 | 0.8379 |
| Base Oil 1/Base Oil 4 (60/40) | Clear | | 0.9917 | 0.9447 | 0.8869 | 0.8348 |
| Base Oil 1/Base Oil 4 (40/60) | Clear | | 0.9850 | 0.9400 | 0.8858 | 0.8310 |
| Base Oil 1/Base Oil 4 (20/80) | Clear | | 0.9916 | 0.9368 | 0.8806 | 0.8331 |
| | | | | | | |
| Base Oil 1/Base Oil 8 (80/20) | Clear | | 0.9962 | 0.9552 | 0.9104 | 0.8649 |
| Base Oil 1/Base Oil 8 (60/40) | Clear | | 0.9998 | 0.9650 | 0.9271 | 0.8916 |
| Base Oil 1/Base Oil 8 (40/60) | Clear | | 0.9835 | 0.9716 | 0.9433 | 0.9182 |
| Base Oil 1/Base Oil 8 (20/80) | Clear | | 0.9946 | 0.9739 | 0.9602 | 0.9414 |

Fig. 5

| | Base Oil 28 | Base Oil 30 | Base Oil 24 | Base Oil 8 |
|---|---|---|---|---|
| | Decene dimer | Decene trimer | 2,6,10,15,19,23-Hexamethyltetracosane | Hydrocarbons, C4, 1,3-butadiene-free, polymd., pentaisobutylene fraction, hydrogenated |
| **% Carbon as Quanternery Carbon*** | 0% | 0% | 0% | 20% |
| **% Carbon as CH*** | 10% | 13.3% | 20% | 5% |
| **% Carbon as CH2*** | 80% | 66.7% | 53.3% | 20% |
| **% Carbon as CH3*** | 20% | 20% | 26.7% | 55% |
| Relative Combution Delay (Normalized to Isoctane), 1% in Isooctane | 0.9204 | 0.9021 | 0.9444 | 1.0292 |
| Relative Combution Delay (Normalized to Isoctane), 5% in Isooctane | 0.6317 | 0.5764 | 0.6804 | 0.8645 |
| Relative Combution Delay (Normalized to Isoctane), 10% in Isooctane | 0.4215 | 0.3455 | 0.4596 | 0.7594 |
| Relative Combution Delay (Normalized to Isoctane), 15% in Isooctane | 0.2753 | 0.2094 | 0.3188 | 0.7703 |

*Estimated based on molecular structure

Fig. 5 (Cont.)

| | Base Oil 4 | Base Oil 5 | Base Oil 6 | Base Oil 7 |
|---|---|---|---|---|
| | Hydrogenated Polyisobutene, Mn 370, Mw/Mn 1.30 | Hydrogenated Polyisobutene, Mn 1300, Mw/Mn 1.65 | Polyisobutene, Mn 440, Mw/Mn 1.80 | 2,6,10,15,19,23-Hexamethyl-2,6,10,14,18,22-tetracosahexaene |
| **% Carbon as Quanternery Carbon*** | 20% | 25% | 25% | 20% |
| **% Carbon as CH*** | 5% | 0% | 0% | 20% |
| **% Carbon as CH2*** | 20% | 25% | 25% | 33.3% |
| **% Carbon as CH3*** | 55% | 50% | 50% | 26.7% |
| Relative Combution Delay (Normalized to Isoctane), 1% in Isooctane | 1.0025 | 0.9743 | 0.9845 | 0.9776 |
| Relative Combution Delay (Normalized to Isoctane), 5% in Isooctane | 0.9752 | 0.8762 | 0.9772 | 0.9905 |
| Relative Combution Delay (Normalized to Isoctane), 10% in Isooctane | 0.9060 | 0.3804 | 0.9825 | 0.9589 |
| Relative Combution Delay (Normalized to Isoctane), 15% in Isooctane | 0.8574 | | 0.9843 | 0.9158 |

*Estimated based on molecular structure

Fig. 6

| | Base Oil 23 | Base Oil 19 | Base Oil 18 |
|---|---|---|---|
| | dipentaerythritol ester | dipentaerythritol ester of brancehd acids | dipentaerythritol ester of brancehd acids |
| **% Carbon as Quanternery Carbon*** | 13% | 15% | 20% |
| **% Carbon as CH*** | 1% | 3% | 0% |
| **% Carbon as CH2*** | 72% | 48% | 43% |
| **% Carbon as CH3*** | 14% | 33% | 37% |
| Relative Combution Delay (Normalized to Isoctane), 1% in Isooctane | 0.94881 | 0.9794 | 0.9820 |
| Relative Combution Delay (Normalized to Isoctane), 5% in Isooctane | 0.70959 | 0.8101 | 0.8575 |
| Relative Combution Delay (Normalized to Isoctane), 10% in Isooctane | 0.52401 | 0.6733 | 0.7382 |
| Relative Combution Delay (Normalized to Isoctane), 15% in Isooctane | 0.39666 | 0.5758 | 0.6451 |

*Determined by DEPT (Distortionless Enhancement by Polarization Transfer) Carbon-13 NMR

Fig. 6 (Cont.)

| | **Base Oil 2** | **Base Oil 10** |
|---|---|---|
| | Monopentaerythritol ester of branched acids | dipentaerythritol ester of brancehd acids |
| **% Carbon as Quanternery Carbon*** | 21% | 23% |
| **% Carbon as CH*** | 2% | 0% |
| **% Carbon as CH2*** | 35% | 31% |
| **% Carbon as CH3*** | 42% | 45% |
| Relative Combution Delay (Normalized to Isoctane), 1% in Isooctane | 1.0207 | 1.0067 |
| Relative Combution Delay (Normalized to Isoctane), 5% in Isooctane | 0.9842 | 0.9511 |
| Combution Delay (Normalized to Isoctane), 10% in Isooctane | 0.9355 | 0.9196 |
| Combution Delay (Normalized to Isoctane), 15% in Isooctane | 0.8982 | 0.8792 |

*Determined by DEPT (Distortionless Enhancement by Polarization Transfer) Carbon-13 NMR

Fig. 7

| Components added to Base Oil 2 | Insoluble | Soluble |
|---|---|---|
| 2 wt% Molybdenum friction modifier | | x |
| 2.7 wt% Mixture of zinc dithiophosphates | | x |
| 1 wt% Phenolic antioxidant | | x |
| 3 wt% Mixture of conventional detergents for lubricants | x | |
| 3.5 wt% Mixture of conventional dispersants based on polyisobutene | x | |

| Components added to Base Oil 1 | Insoluble | Soluble |
|---|---|---|
| 1.7 wt% Proprietary mixture of conventional detergents for lubricants | x | |
| 0.5 wt% Conventional dispersants based on polyisobutene | x | |
| Components added to mixture of Base Oil 1: Base Oil 4 (50:50) | | |
| 1.0 wt% Proprietary mixture of conventional detergents for lubricants | | x |
| 3.0 wt% Conventional dispersants based on polyisobutene | | x |

Fig. 8

| | Example 1 | Example 2 | Example 3 |
|---|---|---|---|
| Component and Method Description | 14050535 | 14057560 | 14072729 |
| Mixture of molybdenum dithiophosphate, primary and secondary zinc dithiophosphates | 3.7 | 3.7 | 3.7 |
| Mixture of molybdenum dithiophosphate, and secondary zinc dithiophosphates | | | |
| Corrosion inhibitor, antioxidants, and antifoam additve | 5.82 | 5.82 | 3.32 |
| Corrosion inhibitor, antioxidants, ashless friction modifier, and overbased detergent | | | |
| Polypropylene glycol stearyl ether | 0.95 | 0.95 | 0.95 |
| Polymethacrylate dispersant | 1.6 | 1.6 | 1.6 |
| Polyalkyl methacrylate copolymer viscosity modifier | | | |
| Dispersant based on polyisobutene | | | |
| Base Oil 2 | 87.93 | | 90.43 |
| Base Oil 10 | | 87.93 | |
| Base Oil 1 | | | |
| Base Oil 4 | | | |

Fig. 8 (Cont.)

| | Example 4 | Example 5 | Example 6 |
|---|---|---|---|
| Component and Method Description | 14072735 | 14072739 | 14075470 |
| Mixture of molybdenum dithiophosphate, primary and secondary zinc dithiophosphates | 3.7 | 3.7 | 3.7 |
| Mixture of molybdenum dithiophosphate, and secondary zinc dithiophosphates | | | |
| Corrosion inhibitor, antioxidants, and antifoam additve | 3.32 | 3.32 | 2.52 |
| Corrosion inhibitor, antioxidants, ashless friction modifier, and overbased detergent | | | |
| Polypropylene glycol stearyl ether | 0.95 | 0.95 | 0.95 |
| Polymethacrylate dispersant | 1.6 | 1.6 | 1.6 |
| Polyalkyl methacrylate copolymer viscosity modifier | | | |
| Dispersant based on polyisobutene | | | |
| Base Oil 2 | 45.43 | 72.43 | 82.23 |
| Base Oil 10 | | | |
| Base Oil 1 | 45 | 18 | 9 |
| Base Oil 4 | | | |

Fig. 8 (Cont.)

| | Example 7 | Comparative Example 1 |
|---|---|---|
| Component and Method Description | 14072308 | Conventional Synthetic Engine Oil |
| Mixture of molybdenum dithiophosphate, primary and secondary zinc dithiophosphates | | |
| Mixture of molybdenum dithiophosphate, and secondary zinc dithiophosphates | 2.55 | |
| Corrosion inhibitor, antioxidants, and antifoam additve | | |
| Corrosion inhibitor, antioxidants, ashless friction modifier, and overbased detergent | 2.97 | |
| Polypropylene glycol stearyl ether | 0.95 | |
| Polymethacrylate dispersant | 0.95 | |
| Polyalkyl methacrylate copolymer viscosity modifier | 9.8 | |
| Dispersant based on polyisobutene | 1.8 | |
| Base Oil 2 | | |
| Base Oil 10 | | |
| Base Oil 1 | 40 | |
| Base Oil 4 | 40.98 | |

Fig. 8 (Cont.)

| | Example 1 | Example 2 | Example 3 |
|---|---|---|---|
| Component and Method Description | 14050535 | 14057560 | 14072729 |
| D4052, Specific Gravity of Liquids, 60 F | 0.961 | | 0.9604 |
| D445, Kinematic Viscosity at 150C, MM2/S | 4.31 | | 4.11 |
| D445, Kinematic Viscosity, 40C, MM2/S | 104 | | 97.85 |
| D445, Kinematic Viscosity, 100C, MM2/S | 11.47 | 25.23 | 10.92 |
| D4683, Apparent Viscosity, CP | | | 3.39 |
| D4951, BORON, MASS% | 0.008 | 0.008 | 0.008 |
| D4951, MAGNESIUM, MASS% | <0.001 | <0.001 | 0.001 |
| D4951, MOLYBDENUM, MASS% | 0.147 | 0.147 | 0.141 |
| D4951, PHOSPHORUS, MASS% | 0.228 | 0.226 | 0.229 |
| D4951, ZINC, MASS% | 0.195 | 0.196 | 0.193 |
| D874, Sulfated Ash, MASS% | | | |

Fig. 8 (Cont.)

| | Example 4 | Example 5 | Example 6 |
|---|---|---|---|
| Component and Method Description | 14072735 | 14072739 | 14075470 |
| D4052, Specific Gravity of Liquids, 60 F | 0.9598 | 0.96 | 0.9599 |
| D445, Kinematic Viscosity at 150C, MM2/S | 1.82 | 2.83 | 3.80 |
| D445, Kinematic Viscosity, 40C, MM2/S | 14.39 | 38.84 | 59.19 |
| D445, Kinematic Viscosity, 100C, MM2/S | 3.58 | 6.52 | 8.32 |
| D4683, Apparent Viscosity, CP | 1.46 | 2.31 | 2.83 |
| D4951, BORON, MASS% | 0.007 | 0.008 | <0.001 |
| D4951, MAGNESIUM, MASS% | 0.001 | 0.002 | 0.002 |
| D4951, MOLYBDENUM, MASS% | 0.142 | 0.146 | 0.145 |
| D4951, PHOSPHORUS, MASS% | 0.229 | 0.228 | 0.232 |
| D4951, ZINC, MASS% | 0.193 | 0.192 | 0.192 |
| D874, Sulfated Ash, MASS% | | | |

Fig. 8 (Cont.)

| | Example 7 | Comparative Example 1 |
|---|---|---|
| Component and Method Description | 14072308 | Conventional Synthetic Engine Oil |
| D4052, Specific Gravity of Liquids, 60 F | | |
| D445, Kinematic Viscosity at 150C, MM2/S | | |
| D445, Kinematic Viscosity, 40C, MM2/S | 47.92 | |
| D445, Kinematic Viscosity, 100C, MM2/S | 12.11 | |
| D4683, Apparent Viscosity, CP | 2.81 | |
| D4951, BORON, MASS% | 0.014 | |
| D4951, MAGNESIUM, MASS% | 0.088 | |
| D4951, MOLYBDENUM, MASS% | 0.121 | |
| D4951, PHOSPHORUS, MASS% | 0.154 | |
| D4951, ZINC, MASS% | 0.123 | |
| D874, Sulfated Ash, MASS% | 0.66 | |

Fig. 8 (Cont.)

| | Example 1 | Example 2 | Example 3 |
|---|---|---|---|
| Component and Method Description | 14050535 | 14057560 | 14072729 |
| Ignition Delay (Normalized to Isoctane) 1% in Isooctane | 0.9180 | 0.8670 | |
| Ignition Delay (Normalized to Isoctane) 5% in Isooctane | 0.7914 | 0.7524 | |
| Ignition Delay (Normalized to Isoctane) 10% in Isooctane | 0.7227 | | |
| Ignition Delay (Normalized to Isoctane) 15% in Isooctane | 0.6860 | | |
| Combution Delay (Normalized to Isoctane) 1% in Isooctane | 1.0091 | 0.9680 | |
| Combution Delay (Normalized to Isoctane) 5% in Isooctane | 0.9480 | 0.9150 | |
| Combution Delay (Normalized to Isoctane) 10% in Isooctane | 0.8908 | | |
| Combution Delay (Normalized to Isoctane) 15% in Isooctane | 0.8309 | | |

Fig. 8 (Cont.)

| | Example 4 | Example 5 | Example 6 |
|---|---|---|---|
| Component and Method Description | 14072735 | 14072739 | 14075470 |
| Relative Ignition Delay (Normalized to Isoctane) 1% in Isooctane | | | |
| Relative Ignition Delay (Normalized to Isoctane) 5% in Isooctane | | | |
| Relative Ignition Delay (Normalized to Isoctane) 10% in Isooctane | | | |
| Relative Ignition Delay (Normalized to Isoctane) 15% in Isooctane | | | |
| Relative Combution Delay (Normalized to Isoctane) 1% in Isooctane | | | |
| Relative Combution Delay (Normalized to Isoctane) 5% in Isooctane | | | |
| Relative Combution Delay (Normalized to Isoctane) 10% in Isooctane | | | |
| Relative Combution Delay (Normalized to Isoctane) 15% in Isooctane | | | |

Fig. 8 (Cont.)

| | Example 7 | Comparative Example 1 |
|---|---|---|
| Component and Method Description | 14072308 | Conventional Synthetic Engine Oil |
| Relative Ignition Delay (Normalized to Isoctane) 1% in Isooctane | 0.8817 | 0.8164 |
| Relative Ignition Delay (Normalized to Isoctane) 5% in Isooctane | 0.7578 | 0.5984 |
| Relative Ignition Delay (Normalized to Isoctane) 10% in Isooctane | | 0.4899 |
| Relative Ignition Delay (Normalized to Isoctane) 15% in Isooctane | | 0.4309 |
| Relative Combution Delay (Normalized to Isoctane) 1% in Isooctane | 0.9579 | 0.9213 |
| Relative Combution Delay (Normalized to Isoctane) 5% in Isooctane | 0.8652 | 0.6374 |
| Relative Combution Delay (Normalized to Isoctane) 10% in Isooctane | | 0.4155 |
| Relative Combution Delay (Normalized to Isoctane) 15% in Isooctane | | 0.2810 |

COMPOSITION AND METHOD FOR PREVENTING OR REDUCING ENGINE KNOCK AND PRE-IGNITION IN HIGH COMPRESSION SPARK IGNITION ENGINES

CROSS-REFERENCE TO RELATED APPLICATIONS

This application claims priority to Provisional Application U.S. Ser. No. 62/051,545 filed on Sep. 17, 2014, which is herein incorporated by reference in its entirety.

FIELD

This disclosure relates to a lubricant composition for high compression spark ignition engines that contains at least one branched hydrocarbon having at least about 25% of the carbons in the form of methyl groups or at least one polyol ester having at least about 25% of the carbons in the form of methyl groups. This disclosure also relates to a method for preventing or reducing engine knock and pre-ignition in an engine lubricated with a formulated oil. The formulated oil has a composition comprising at least one branched hydrocarbon having at least about 25% of the carbons in the form of methyl groups, or at least one polyol ester having at least about 25% of the carbons in the form of methyl groups. The lubricating oils of this disclosure are useful as passenger vehicle engine oil (PVEO) products.

BACKGROUND

In a 4-stroke cycle gasoline engine, the combustion process is, by design, initiated by the spark-plug at the right crank angle, leading to optimum energy output. If the fuel-air mixture ignites under compression, either prior to the spark or in the unburned fuel-air mixture being heated and compressed by the propagating flame, abnormal combustion may occur. Examples of this are engine knock (detonation after the spark) or pre-ignition. These undesirable events may result in engine damage.

The resistance to abnormal combustion events of a fuel is rated on one of several octane scales, such as the Research Octane Number (RON), Motor Octane Number (MON), or the Supercharged Rich Octane method. Higher octane numbers indicate a resistance to combustion, and are associated with in increased ignition delay. Generally, aromatics, naphthenes, alkenes, and branched alkane molecules increase the octane number of a fuel, while linear paraffins decrease the octane number of a fuel. However, most of the existing data are limited to low molecular weight molecules, generally with carbon numbers 20 or below.

Oxygenate additives such as methanol, ethanol, and MTBE are known to increase octane number. However, there are performance concerns associated with methanol (e.g., corrosion) and ethanol (e.g., elastomer compatibility), and environmental concerns associated with MTBE. In addition, these oxygenates are not suitable for use in a lubricant composition.

Today's high performance engines are trending toward higher compression ratios (11 or higher), in order to generate higher power at a given engine displacement. As the compression ratio increases, the fuel-air mixture has a higher propensity to ignite by compression, resulting in detonation of the unburned end gases (knocking) or pre-ignition.

Traditional spark knocking can be controlled by retarding spark timing or by reducing the super- or turbo-charger boost pressure. Hot-spot pre-ignition is prevented by engine hardware design and limiting the temperatures in the combustion chamber. However, these measures also reduce the efficiency of the engine. An approach preferred by engine manufacturers is to use fuels that are less likely to be ignited by compression.

Engine oils usually contain 80-90% of hydrocarbon base oils. These hydrocarbons include long linear hydrocarbons and ignite easily under compression. During normal engine operation, some of the engine oil exists in the combustion chamber, leading to the concern that engine oil contributes to engine knocking and pre-ignition.

Under high brake mean effective pressure (BMEP) and low engine speed (RPM), some modern internal engines experience an abnormal combustion phenomenon called low speed pre-ignition (LSPI) or "super knock". It is known that LSPI can lead to severe engine damage.

Although engine knocking and pre-ignition problems can be and are being resolved by optimization of internal engine components and by the use of new component technology such as electronic controls and knock sensors, modification of the lubricating oil compositions used to lubricate such engines and fuel compositions would be desirable. For example, it would be desirable to develop new lubricating oil formulations or fuel compositions which are particularly useful in high compression spark ignition internal combustion engines and, when used in these internal combustion engines, will prevent or minimize the engine knocking and pre-ignition problems. It is desired that the lubricating oil composition and fuel composition be useful in lubricating gasoline-fueled, and natural gas, liquefied petroleum gas, or dimethyl ether-fueled spark ignition engines.

SUMMARY

This disclosure relates in part to new lubricating oil formulations and fuel formulations which are particularly useful in high compression spark ignition engines and, when used in high compression spark ignition engines, will prevent or minimize engine knocking and pre-ignition problems. The lubricating oil compositions and fuel compositions of this disclosure are useful in high compression spark ignition engines, including gasoline-fueled, and natural gas, liquefied petroleum gas, or dimethyl ether-fueled spark ignition engines. The lubricant formulation and fuel formulation chemistry of this disclosure can be used to prevent or control the detrimental effect of engine knocking and pre-ignition in engines which have already been designed or sold in the marketplace as well as future engine technology. The lubricant formulation and fuel formulation solutions afforded by this disclosure for preventing or reducing engine knocking and pre-ignition problems enables product differentiation with regard to the engine knocking and pre-ignition problems.

This disclosure also relates in part to a method for preventing or reducing engine knock or pre-ignition in an engine lubricated with a lubricating oil by using as the lubricating oil a formulated oil. The formulated oil has a composition comprising at least one branched hydrocarbon having at least about 25% of the carbons in the form of methyl groups. The at least one branched hydrocarbon preferably has at least about 20 carbon atoms. The at least one branched hydrocarbon preferably comprises at least one poly(branched alkene) such as polyisobutene or hydrogenated polyisobutene or at least one branched alkane such as isoeicosane or one branched alkene such squalene.

This disclosure also relates in part to a method for preventing or reducing engine knock or pre-ignition in an engine lubricated with a lubricating oil by using as the lubricating oil a formulated oil. The formulated oil has a composition comprising at least one branched polyol ester. The at least one branched polyol ester preferably has at least about 17 carbon atoms. The at least one branched polyol ester preferably comprises at least one polyol ester of at least one branched mono-carboxylic acid. The at least one branched polyol ester of at least one mono-carboxylic acid preferably comprises a mono-pentaerythritol ester of at least one branched mono-carboxylic acid or a di-pentaerythritol ester of at least one branched mono-carboxylic acid, having at least 25% of the total carbons in the form of methyl groups.

This disclosure further relates in part to a method for preventing or reducing engine knock or pre-ignition in an engine lubricated with a lubricating to oil by using as the lubricating oil a formulated oil. The formulated oil has a composition comprising a lubricating oil base stock as a major component; and at least one cobase stock, as a minor component. The cobase stock comprises at least one branched hydrocarbon having at least about 25% of the carbons in the form of methyl groups. The at least one branched hydrocarbon preferably has at least about 20 carbon atoms. The at least one branched hydrocarbon preferably comprises at least one poly(branched alkene) such as polyisobutene or hydrogenated polyisobutene or at least one branched alkane such as isoeicosane or at least one branched alkene such as squalene.

This disclosure yet further relates in part to a method for preventing or reducing engine knock or pre-ignition in an engine lubricated with a lubricating oil by using as the lubricating oil a formulated oil. The formulated oil has a composition comprising a lubricating oil base stock as a major component; and at least one cobase stock, as a minor component. The cobase stock comprises at least one branched polyol ester. The at least one branched polyol ester preferably has at least about 17 carbon atoms. The at least one branched polyol ester preferably comprises at least one polyol ester of at least one branched mono-carboxylic acid. The at least one branched polyol ester of at least one mono-carboxylic acid preferably comprises a mono-pentaerythritol ester of at least one branched mono-carboxylic acid or a di-pentaerythritol ester of at least one branched mono-carboxylic acid, having at least 25% of the total carbons in the form of methyl groups.

This disclosure also relates in part to a lubricating engine oil for high compression spark-ignition engines having a composition comprising at least one branched hydrocarbon having at least about 25% of the carbons in the form of methyl groups. The at least one branched hydrocarbon preferably has at least about 20 carbon atoms. The at least one branched hydrocarbon preferably comprises at least one poly(branched alkene) such as polyisobutene or hydrogenated polyisobutene, or at least one branched alkane such as isoeicosane, or at least one branched alkene such as squalene.

This disclosure further relates in part to a lubricating engine oil for high compression spark-ignition engines having a composition comprising at least one branched polyol ester. The at least one branched polyol ester preferably has at least about 17 carbon atoms. The at least one branched polyol ester preferably comprises at least one polyol ester of a branched mono-carboxylic acid. The at least one branched polyol ester of a branched mono-carboxylic acid preferably comprises a mono-pentaerythritol ester of a branched mono-carboxylic acid or a di-pentaerythritol ester of a branched mono-carboxylic acid, having at least about 25% of the total carbons in the form of methyl groups.

This disclosure yet further relates in part to a lubricating engine oil for high compression spark-ignition engines having a composition comprising a lubricating oil base stock as a major component, and at least one cobase stock, as a minor component. The cobase stock comprises at least one branched hydrocarbon having at least about 25% of the carbons in the form of methyl groups. The at least one branched hydrocarbon preferably has at least about 20 carbon atoms. The at least one branched hydrocarbon preferably comprises at least one poly(branched alkene) such as polyisobutene or hydrogenated polyisobutene or at least one branched alkane such as isoeicosane or at least one branched alkene such as squalene.

This disclosure also relates in part to a lubricating engine oil for high compression spark-ignition engines having a composition comprising a lubricating oil base stock as a major component, and at least one cobase stock, as a minor component. The cobase stock comprises at least one branched polyol ester. The at least one branched polyol ester has at least about 17 carbon atoms. The at least one branched polyol ester preferably comprises at least one polyol ester of at least one branched mono-carboxylic acid. The at least one branched polyol ester of at least one branched mono-carboxylic acid preferably comprises a mono-pentaerythritol ester of at least one branched mono-carboxylic acid or a di-pentaerythritol ester of at least one branched mono-carboxylic acid, having at least about 25% of the total carbons in the form of methyl groups.

This disclosure further relates in part to a method for preventing or reducing engine knock or pre-ignition in a spark ignition engine by using a fuel additive composition in a gasoline fuel composition. The gasoline fuel composition is used in a high compression spark ignition internal combustion engine. The fuel additive composition comprises at least one branched hydrocarbon having at least about 25% of the carbons in the form of methyl groups. The at least one branched hydrocarbon preferably has at least about 20 carbon atoms. The at least one branched hydrocarbon preferably comprises at least one poly(branched alkene) such as polyisobutene or hydrogenated polyisobutene or at least one branched alkane such as isoeicosane or at least one branched alkene such as squalene. The gasoline fuel composition includes, but is not limited to, biofuels.

This disclosure yet further relates in part to a method for preventing or reducing engine knock or pre-ignition in a high compression spark ignition engine by using a fuel additive composition in a gasoline fuel composition. The gasoline fuel composition is used in a spark ignition internal combustion engine. The fuel additive composition comprises at least one branched polyol ester. The at least one branched polyol ester preferably has at least about 17 carbon atoms. The at least one branched polyol ester preferably comprises at least one branched polyol ester of at least one branched mono-carboxylic acid. The at least one branched polyol ester of at least one mono-carboxylic acid preferably comprises a mono-pentaerythritol ester of at least one branched mono-carboxylic acid or a di-pentaerythritol ester of at least one branched mono-carboxylic acid, having at least 25% of the total carbons in the form of methyl groups. The gasoline fuel composition includes, but is not limited to, biofuels.

This disclosure further relates in part to a fuel additive composition for use in a gasoline fuel composition. The gasoline fuel composition is used in a high compression spark ignition internal combustion engine. The fuel additive composition comprises at least one branched hydrocarbon having at least about 25% of the carbons in the form of methyl groups. The at least one branched hydrocarbon preferably has at least about 20 carbon atoms. The at least one branched hydrocarbon preferably comprises at least one poly(branched alkene) such as polyisobutene or hydrogenated polyisobutene or at least one branched alkane such as isoeicosane or at least one branched alkene such as squalene. The gasoline fuel composition includes, but is not limited to, biofuels.

This disclosure yet further relates in part to a fuel additive composition for use in a gasoline fuel composition. The gasoline fuel composition is used in a high compression spark ignition internal combustion engine. The fuel additive composition comprises at least one branched polyol ester. The at least one branched polyol ester preferably has at least about 17 carbon atoms. The at least one branched polyol ester preferably comprises at least one branched polyol ester of at least one branched mono-carboxylic acid. The at least one branched polyol ester of at least one branched mono-carboxylic acid preferably comprises a mono-pentaerythritol ester of at least one branched mono-carboxylic acid or a di-pentaerythritol ester of at least one branched mono-carboxylic acid, having at least about 25% of the total carbons in the form of methyl groups. The gasoline fuel composition includes, but is not limited to, biofuels.

This disclosure yet further relates in part to a gasoline fuel composition for use in a high compression internal combustion engine. The gasoline fuel composition comprises gasoline fuel and a fuel additive composition comprising at least one branched hydrocarbon having at least about 25% of the carbons in the form of methyl groups. The at least one branched hydrocarbon preferably has at least about 20 carbon atoms. The at least one branched hydrocarbon preferably comprises at least one poly(branched alkene) such as polyisobutene or hydrogenated polyisobutene or at least one branched alkane such as isoeicosane or at least one branched alkene such as squalene.

This disclosure also relates in part to a gasoline fuel composition for use in a high compression internal combustion engine. The gasoline fuel composition comprises gasoline fuel and a fuel additive composition comprising at least one branched polyol ester. The at least one branched polyol ester preferably has at least about 17 carbon atoms. The at least one branched polyol ester preferably comprises at least one branched polyol ester of at least one branched mono-carboxylic acid. The at least one branched polyol ester of at least one branched mono-carboxylic acid preferably comprises a mono-pentaerythritol ester of at least one branched mono-carboxylic acid or a di-pentaerythritol ester of at least one branched mono-carboxylic acid, having at least about 25% of the total carbons in the form of methyl groups.

This disclosure further relates in part to a composition for use in a high compression internal combustion engine. The composition comprises at least one branched hydrocarbon having at least about 25% of the carbons in the form of methyl groups. The at least one branched hydrocarbon preferably has at least about 20 carbon atoms. The at least one branched hydrocarbon preferably comprises at least one poly(branched alkene) such as polyisobutene or hydrogenated polyisobutene or at least one branched alkane such as isoeicosane or at least one branched alkene such as squalene.

This disclosure further relates in part to a composition for use in a high compression internal combustion engine. The composition comprises at least one branched polyol ester. The at least one branched polyol ester preferably has at least about 17 carbon atoms. The at least one branched polyol ester preferably comprises at least one branched polyol ester of at least one branched mono-carboxylic acid. The at least one branched polyol ester of at least one branched mono-carboxylic acid preferably comprises a mono-pentaerythritol ester of at least one branched mono-carboxylic acid or a di-pentaerythritol ester of at least one branched mono-carboxylic acid, having at least about 25% of the total carbons in the form of methyl groups.

It has been surprisingly found that, in accordance with this disclosure, prevention or reduction of engine knocking and pre-ignition problems in a high compression spark ignition engine can be attained in an engine by using as the lubricating oil a formulated oil comprising at least one branched hydrocarbon having at least about 25% of the carbons in the form of methyl groups, or at least one branched polyol ester. The branched hydrocarbon preferably comprises at least one poly(branched alkene) or at least one branched alkane or at least one branched alkene. The preferred poly(branched alkene) is polyisobutene or hydrogenated polyisobutene. The preferred branched alkane is isoeicosane. The preferred branched alkene is squalene. The preferred branched polyol ester is a mono-pentaerythritol ester of a branched mono-carboxylic acid, a di-pentaerythritol ester of a branched mono-carboxylic acid, having at least about 25% of the total carbons in the form of methyl groups.

Also, it has been surprisingly found that, in accordance with this disclosure, prevention or reduction of engine knocking and pre-ignition problems can be attained in a high compression spark ignition engine by using a fuel additive composition of this disclosure in a gasoline fuel. The gasoline has a particular fuel additive present in a particular amount (e.g., a ratio of a fuel additive composition:gasoline fuel volume ratio of greater than about 1:1000 to 1:10) in the gasoline fuel composition. The particular fuel additive comprises at least one branched hydrocarbon having at least about 25% of the carbons in the form of methyl groups, or at least one branched polyol ester. The branched hydrocarbon preferably comprises at least one poly(branched alkene) or at least one branched alkane or at least one branched alkene. The preferred poly(branched alkene) is polyisobutene or hydrogenated polyisobutene. The preferred branched alkane is isoeicosane. The preferred branched alkene is squalene. The preferred branched polyol ester is a mono-pentaerythritol ester of a branched mono-carboxylic acid or a di-pentaerythritol ester of a branched mono-carboxylic acid, having at least about 25% of the total carbons in the form of methyl groups.

It has further been found that, in accordance with this disclosure, prevention or reduction of engine knocking and pre-ignition problems is related to the degree of branching in the poly(branched alkene) polymers, branched alkanes and branched polyol esters. Preferably, the poly(branched alkene) polymers, branched alkanes, branched alkene, and branched polyol esters have at least about 25% of the carbons in the form of methyl groups. Even more preferably, the poly(branched alkene) polymers, branched alkanes and branched polyol esters have at least about 35% of the carbons in the form of methyl groups. Even more preferably, the poly(branched alkene) polymers, branched alkanes and branched polyol esters have at least about 40% of the carbons in the form of methyl groups. Most preferably, the poly(branched alkene) polymers, branched alkanes and branched polyol esters have at least about 50% of the carbons in the form of methyl groups. In addition to the carbons in the form of methyl groups, it is further preferred that at least about 20% of the carbons are in the form of quaternary carbons.

Other objects and advantages of the present disclosure will become apparent from the detailed description that follows.

BRIEF DESCRIPTION OF THE DRAWINGS

FIG. 1 shows ignition delay (in ms) data generated from the Herzogs Cetane ID 510 analyzer testing of the various lubricant base oils in isooctane in accordance with Example 1.

FIG. 2 shows combustion delay (in ms) data generated from a Herzogs Cetane ID 510 analyzer testing of the various lubricant base oils in isooctane in accordance with Example 1.

FIG. 3 shows ignition delay (in ms) data generated from the Herzogs Cetane ID 510 analyzer testing of the various lubricant base oil mixtures in isooctane in accordance with Example 2.

FIG. 4 shows combustion delay (in ms) data generated from a Herzogs Cetane ID 510 analyzer testing of the various lubricant base oil mixtures in isooctane in accordance with Example 2.

FIG. 5 shows hydrocarbon content and combustion delay (in ms) data generated from a Herzogs Cetane ID 510 analyzer testing of the various lubricant base oils in isooctane in accordance with Example 3.

FIG. 6 shows hydrocarbon content and combustion delay (in ms) data generated from a Herzogs Cetane ID 510 analyzer testing of the various lubricant base oils in isooctane in accordance with Example 4.

FIG. 7 shows lubricant component solubility test results conducted for various additive components in accordance with Example 5.

FIG. 8 shows formulations prepared in accordance with Example 6 and also testing results from the formulations.

DETAILED DESCRIPTION

All numerical values within the detailed description and the claims herein are modified by "about" or "approximately" the indicated value, and take into account experimental error and variations that would be expected by a person having ordinary skill in the art.

It has now been found that the lubricating oil formulations or fuel compositions of this disclosure which are particularly useful in high compression spark ignition internal combustion engines and, when used in the high compression spark ignition internal combustion engines, will prevent or minimize engine knocking and pre-ignition problems. Prevention or reduction of engine knocking and/or pre-ignition problems can be attained in an engine lubricated with a lubricating oil by using as the lubricating oil a formulated oil that has at least one branched hydrocarbon having at least about 25% of the carbons in the form of methyl groups, or at least one branched polyol ester. The branched hydrocarbon preferably comprises at least one poly(branched alkene) or at least one branched alkane or at least one branched alkene. The preferred poly(branched alkene) is polyisobutene or hydrogenated polyisobutene. The preferred branched alkane is isoeicosane. The preferred branched alkene is squalene. The preferred branched polyol ester is a mono-pentaerythritol ester of a branched mono-carboxylic acid or a di-pentaerythritol ester of a branched mono-carboxylic acid, having at least 25% of the total carbons in the form of methyl groups.

In addition, it has been found that the prevention or minimization of engine knocking and pre-ignition problems can be attained in an engine by using a fuel additive composition in a gasoline fuel. The gasoline fuel is used in a high compression spark ignition internal combustion engine. The fuel additive composition comprises at least one branched hydrocarbon having at least about 25% of the carbons in the form of methyl groups, or at least one branched polyol ester. The branched hydrocarbon preferably comprises at least one poly(branched alkene) or at least one branched alkane or one branched alkene. The preferred poly(branched alkene) is polyisobutene or hydrogenated polyisobutene. The preferred branched alkane is isoeicosane. The preferred branched alkene is squalene. The preferred branched polyol ester is a mono-pentaerythritol ester of at least one branched mono-carboxylic acid or a di-pentaerythritol ester of at least one branched mono-carboxylic acid, having at least about 25% of the total carbons in the form of methyl groups. The lubricating oils and fuel compositions of this disclosure are particularly advantageous as passenger vehicle products.

The lubricating oils of this disclosure are particularly useful in high compression spark ignition internal combustion engines and, when used in high compression spark ignition internal combustion engines, will prevent or minimize engine knocking and pre-ignition problems. The lubricating oil compositions of this disclosure are useful in lubricating high compression spark ignition engines. The fuel additive compositions of this disclosure are useful in gasoline fuels.

As indicated herein, the lubricating oil formulations or fuel compositions of this disclosure are particularly useful in high compression spark ignition engines and, when used in the high compression spark ignition engines, will prevent or minimize engine knocking and pre-ignition problems. The high compression spark ignition engines include, for example, super-charged engines and turbo-charged engines. The high compression spark ignition engines have a compression ratio of at least about 11, preferably at least about 13, and more preferably at least about 15.

As used herein, the term "iso" refers to any single isomer or a mixture of isomers. For example, isoeicosane refers to a mixture of highly branched hydrocarbons with average molecular weight close to isoeicosane, and not just to 2-methyl nonadecane.

Lubricating Oil Base Stocks

A wide range of lubricating base oils is known in the art. Lubricating base oils that are useful in the present disclosure are both natural oils, and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org) to create guidelines for lubricant base oils. Group I base stocks have a viscosity index of between about 80 to 120 and contain greater than about 0.03% sulfur and/or less than about 90% saturates. Group II base stocks have a viscosity index of between about 80 to 120, and contain less than or equal to about 0.03% sulfur and greater than or equal to about 90% saturates. Group III stocks have a viscosity index greater than about 120 and contain less than or equal to about 0.03% sulfur and greater than about 90% saturates. Group IV includes polyalphaolefins (PAO). Group V base stock includes base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Polyalphaolefins (PAO) | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked base stocks, including synthetic oils such as polyalphaolefins, alkyl aromatics and synthetic esters are also well known base stock oils.

Synthetic oils include hydrocarbon oil. Hydrocarbon oils include oils such as polymerized and interpolymerized olefins (polybutylenes, polypro-pylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from about 250 to about 3,000, although PAO's may be made in viscosities up to about 150 cSt (100° C.). The PAOs are typically comprised of relatively low molecular weight hydrogenated polymers or oligomers of alphaolefins which include, but are not limited to, $C_2$ to about $C_{32}$ alphaolefins with the $C_8$ to about $C_{16}$ alphaolefins, such as 1-hexene, 1-octene, 1-decene, 1-dodecene and the like, being preferred. The preferred polyalphaolefins are poly-1-hexene, poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity base stocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt. PAO fluids of particular use may include 3.0 cSt, 3.4 cSt, and/or 3.6 cSt and combinations thereof. Bi-modal mixtures of PAO fluids having a viscosity range of 1.5 to 150 cSt may be used if desired.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or U.S. Pat. No. 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

Other useful lubricant oil base stocks include wax isomerate base stocks and base oils, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks and base oils, and other wax isomerate hydroisomerized base stocks and base oils, or mixtures thereof. Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, the disclosure of which is incorporated herein by reference in its entirety. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359. Each of the aforementioned patents is incorporated herein in their entirety. Particularly favorable processes are described in European Patent Application Nos. 464546 and 464547, also incorporated herein by reference. Processes using Fischer-Tropsch wax feeds are described in U.S. Pat. Nos. 4,594,172 and 4,943,672, the disclosures of which are incorporated herein by reference in their entirety.

Gas-to-Liquids (GTL) base oils, Fischer-Tropsch wax derived base oils, and other wax-derived hydroisomerized (wax isomerate) base oils be advantageously used in the instant disclosure, and may have useful kinematic viscosities at 100° C. of about 3 cSt to about 50 cSt, preferably about 3 cSt to about 30 cSt, more preferably about 3.5 cSt to about 25 cSt, as exemplified by GTL 4 with kinematic viscosity of about 4.0 cSt at 100° C. and a viscosity index of about 141. These Gas-to-Liquids (GTL) base oils, Fischer-Tropsch wax derived base oils, and other wax-derived hydroisomerized base oils may have useful pour points of about −20° C. or lower, and under some conditions may have advantageous pour points of about −25° C. or lower, with useful pour points of about −30° C. to about −40° C. or lower. Useful compositions of Gas-to-Liquids (GTL) base oils, Fischer-Tropsch wax derived base oils, and wax-derived hydroisomerized base oils are recited in U.S. Pat. Nos. 6,080,301; 6,090,989, and 6,165,949 for example, and are incorporated herein in their entirety by reference.

The hydrocarbyl aromatics can be used as base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of about $C_8$ to about $C_{20}$ often being preferred. A mixture of hydrocarbyl groups is often preferred, and up to about three such substituents may be present. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 3 cSt to about 50 cSt are preferred, with viscosities of approximately 3.4 cSt to about 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be about 2% to about 25%, preferably about 4% to about 20%, and more preferably about 4% to about 15%, depending on the application.

Alkylated aromatics such as the hydrocarbyl aromatics of the present disclosure may be produced by well-known Friedel-Crafts alkylation of aromatic compounds. See Friedel-Crafts and Related Reactions, Olah, G. A. (ed.), Interscience Publishers, New York, 1963. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, New York, 1964. Many homogeneous or heterogeneous, solid catalysts are known to one skilled in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Newer alkylation technology uses zeolites or solid super acids.

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of −5° C. to about −40° C. or lower (ASTM D97). They are also characterized typically as having viscosity indices of about 80 to about 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

Base oils for use in the formulated lubricating oils useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features.

The base oil constitutes the major component of the engine oil lubricant composition of the present disclosure and typically is present in an amount ranging from about 50 to about 99 weight percent, preferably from about 70 to about 95 weight percent, and more preferably from about 85 to about 95 weight percent, based on the total weight of the composition. The base oil may be selected from any of the synthetic or natural oils typically used as crankcase lubricating oils for spark ignition and compression-ignited engines. The base oil conveniently has a kinematic viscosity, according to ASTM standards, of about 2.5 cSt to about 12 cSt (or $mm^2/s$) at 100° C. and preferably of about 2.5 cSt to about 9 cSt (or $mm^2/s$) at 100° C. Mixtures of synthetic and natural base oils may be used if desired. Mixtures of Group III, IV, V may be preferable.

Branched Hydrocarbon Base Oils

In accordance with this disclosure, branched hydrocarbons are useful base stocks. The branched hydrocarbons can have at least about 25%, or at least about 35%, or at least about 50% or higher, of the carbons in the form of methyl groups. In addition to the carbons in the form of methyl groups, it is further preferred that at least about 20% of the carbons are in the form of quaternary carbons.

The branched hydrocarbons can have at least about 20 carbon atoms, or at least about 24 carbon atoms, or at least about 28 carbon atoms, or higher numbers of carbon atoms.

Illustrative branched hydrocarbons useful in this disclosure include poly(branched alkene) polymers, branched alkanes, and branched alkenes. The is poly(branched alkene) polymers are derived from a C4 to C28 branched alkenes, preferably C4 to C24 branched alkenes, more preferably C4 to C20 branched alkenes, and even more preferably C4 to C16 branched alkenes.

The number average molecular weights of the poly (branched alkene) polymers, which are known materials and generally available on a major commercial scale from suppliers such as Ineos under the trade name Indopol™, typically vary from about 250 to about 3,000.

The poly(branched alkene) fluids may be conveniently made by the polymerization of a branched alkene in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or U.S. Pat. No. 3,382,291 may be conveniently used herein. Other descriptions of poly(branched alkene) synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487.

Illustrative poly(branched alkene) polymers include, for example, polyisobutene, poly(2-methyl-1-butene), poly(3-methyl-1-butene), poly(2-methyl-2-butene), poly(4-methyl-1-pentene), poly(5-methyl-1-hexene), poly(6-methyl-1-heptene), poly(7-methyl-1-octene), poly(8-methyl-1-nonene), poly(9-methyl-1-decene), poly(10-methyl-1-undecene), poly(11-methyl-1-dodecene), poly(12-methyl-1-tridecene), poly(13-methyl-1-tetradecene), poly(14-methyl-1-pentadecene), poly(15-methyl-1-hexadecene), and the like.

Preferred poly(branched alkene) polymers useful in this disclosure include, for example, polyisobutene, hydrogenated polyisobutene, and the like.

Preferably, the poly(branched alkene) polymers have at least about 25% of the carbons in the form of methyl groups. Even more preferably, the poly(branched alkene) polymers have at least about 35% of the carbons in the form of methyl groups. Most preferably, the poly(branched alkene) polymers have at least about 50% of the carbons in the form of methyl groups. In addition to the carbons in the form of methyl groups, it is further preferred that at least about 20% of the carbons are in the form of quaternary carbons.

Illustrative branched alkanes useful in this disclosure include C20 to C54 branched alkanes. In particular, illustrative branched alkanes include, for example, isoeicosane, branched heneicosane, branched docosane, branched tricosane, branched tetracosane, branched pentacosane, branched hexacosane, branched heptacosane, branched octacosane, branched nonacosane, branched triacontane, squalane, and the like.

Preferred branched alkanes useful in this disclosure include, for example, branched alkanes having from about 20 to about 40 carbons, for example, isoeicosane, squalane, 2,2,4,10,12,12-hexamethyl-7-(3,5,5-trimethylhexyl)tridecane, and the like.

Preferably, the branched alkanes have at least about 25% of the carbons in the form of methyl groups. Even more preferably, the branched alkanes have at least about 35% of the carbons in the form of methyl groups. Most preferably, the branched alkanes have at least about 50% of the carbons in the form of methyl groups. In addition to the carbons in the form of methyl groups, it is further preferred that at least about 20% of the carbons are in the form of quaternary carbons.

Illustrative branched alkenes useful in this disclosure include C20 to C54 branched alkenes. Preferred branched alkenes useful in this disclosure include, for example, branched alkenes having from about 20 to about 40 carbons, for example, squalene, and the like.

Preferably, the branched alkenes have at least about 25% of the carbons in the form of methyl groups. Even more preferably, the branched alkenes have at least about 35% of the carbons in the form of methyl groups. Most preferably, the branched alkenes have at least about 50% of the carbons in the form of methyl groups.

Branched alkanes like squalane, branched alkenes like squalene, and hydrogenated polyisobutene like Panalane™ from Ineos are widely used in cosmetics. Squalane and squalene can also be derived from natural sources.

The branched hydrocarbon can be present in an amount of from about 1 to about 100 weight percent, or from about 5 to about 95 weight percent, or from about 10 to about 90 weight percent, or from about 20 to about 80 weight percent, based on the total weight of the formulated oil.

When the branched hydrocarbon, preferably a poly (branched alkene) or a branched alkane or a branched alkene, is used as a cobase stock, the lubricating oil base stock is present in an amount of from about 40 weight percent to about 100 weight percent, and the branched hydrocarbon, preferably a poly(branched alkene) or a branched alkane or a branched alkene, is present in an amount from about 1.0 to about 40 weight percent, based on the total weight of the lubricating oil.

Ester Base Oils

Esters comprise a useful base stock. Additive solvency and seal compatibility characteristics may be secured by the use of esters such as polyol esters of monocarboxylic acids and esters of dibasic acids with monoalkanols.

Particularly useful synthetic esters are branched polyol esters which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with single or mixed branched mono-carboxylic acids containing at least about 4 carbon atoms, preferably $C_5$ to $C_{30}$ branched monocarboxylic acids including 2,2-dimethyl propionic acid (neopentanoic acid), neoheptanoic acid, neooctanoic acid, neononanoic acid, iso-hexanoic acid, neodecanoic acid, 2-ethyl hexanoic acid (2EH), 3,5,5-trimethyl hexanoic acid (TMH), isoheptanoic acid, isooctanoic acid, isononanoic acid, isodecanoic acid, or mixtures of any of these materials. These branched polyol esters include fully converted and partially converted polyol esters.

Particularly useful polyols include, for example, neopentyl glycol, 2,2-dimethylol butane, trimethylol ethane, trimethylol propane, trimethylol butane, mono-pentaerythritol, technical grade pentaerythritol, di-pentaerythritol, tri-pentaerythritol, ethylene glycol, propylene glycol and polyalkylene glycols (e.g., polyethylene glycols, polypropylene glycols, 1,4-butanediol, sorbitol and the like, 2-methylpropanediol, polybutylene glycols, etc., and blends thereof such as a polymerized mixture of ethylene glycol and propylene glycol). The most preferred alcohols are technical grade (e.g., approximately 88% mono-, 10% di- and 1-2% tri-pentaerythritol)pentaerythritol, mono-pentaerythritol, di-pentaerythritol, neopentyl glycol and trimethylol propane.

Particularly useful branched mono-carboxylic acids include, for example, 2,2-dimethyl propionic acid (neopentanoic acid), neoheptanoic acid, neooctanoic acid, neononanoic acid, iso-hexanoic acid, neodecanoic acid, 2-ethyl hexanoic acid (2EH), 3,5,5-trimethyl hexanoic acid (TMH), isoheptanoic acid, isooctanoic acid, isononanoic acid, isodecanoic acid, or mixtures of any of these materials. One especially preferred branched acid is 3,5,5-trimethyl hexanoic acid. The term "neo" as used herein refers to a trialkyl acetic acid, i.e., an acid which is triply substituted at the alpha carbon with alkyl groups.

Mono- and/or di-carboxylic linear acids may be useful in this disclosure, and include any linear alkyl carboxylic acid having a carbon number in the range between about C2 to C18, preferably C2 to C10.

Preferably, the branched polyol ester is derived from a polyhydric alcohol and a branched mono-carboxylic acid. Even more preferably, the branched mono-carboxylic acid and the polyol ester have at least about 25% of the carbons in the form of methyl groups. Even more preferably, the branched mono-carboxylic acid and the polyol ester have at least about 35% of the carbons in the form of methyl groups. Even more preferably, the branched mono-carboxylic acid and the polyol ester have at least about 40% of the carbons in the form of methyl groups. Most preferably, the branched mono-carboxylic acid and the polyol ester have at least about 50% of the carbons in the form of methyl groups. In addition to the carbons in the form of methyl groups, it is further preferred that at least about 20% of the carbons are in the form of quaternary carbons.

The percentage of carbons in the form of methyl groups can also be determined by use of Carbon-13 Nuclear Magnetic Resonance (NMR) method. Preferably, the percentage of carbons in the form of methyl groups is determined with the help of Distortionless Enhancement by Polarization Transfer (DEPT) Carbon-13 NMR method.

Preferred polyol esters useful in this disclosure include, for example, mono-pentaerythritol ester of branched monocarboxylic acids, di-pentaerythritol ester of branched monocarboxylic acids, trimethylolpropane ester of C8-C10 acids, and the like.

Other synthetic esters that can be useful in this disclosure are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with mono caboxylic acids containing at least about 4 carbon atoms, preferably branched $C_5$ to $C_{30}$ acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Illustrative esters useful in this disclosure include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Also useful are esters derived from renewable material such as coconut, palm, rapeseed, soy, sunflower and the like. These esters may be monoesters, di-esters, polyol esters, complex esters, or mixtures thereof. These esters are widely available commercially, for example, the Mobil P-51 ester of ExxonMobil Chemical Company.

Other ester base oils useful in this disclosure include adipate esters and more preferably dialkyl adipate esters such as diisopropyl adipate, diisobutyl adipate, diisopentyl adipate, diisohexyl adipate, diisooctyl adipate, diisononyl adipate, diisodecyl adipate, diisododecyl adipate, and mixtures thereof. Preferably, the dialkyl adipate ester comprises diisobutyl adipate. For lower volatility, the preferred dialkyl adipate ester comprises diisooctyl adipate, diisononyl adipate, diisodecyl adipate, diisododecyl adipate, or their mixtures.

Preferably, the dialkyl adipate ester is derived from an adipic acid and an alkyl alcohol (e.g., isobutyl alcohol, butyl alcohol, hexyl alcohol, dodecyl alcohol, and the like). Particularly useful branched alkyl alcohols include, for example, 2,2-dimethyl propanol (neopentanol), neoheptanol, neooctanol, neononanol, neo-hexanol, neodecanol, 2-ethyl hexanol (2EH), 3,5,5-trimethyl hexanol, isoheptanol, isononanol, isodecanol, isododecanol, isotridecanol, isotetradecanol, isohexadecanol, isooctadecanol (isostearyl alcohol), or mixtures of any of these materials. One especially preferred branched alcohol is 3,5,5-trimethyl hexanol. The term "neo" as used herein refers to a trialkyl ethanol, i.e., an alcohol which is triply substituted at the alpha carbon with alkyl groups.

More preferably, the dialkyl adipate ester is derived from adipic acid and a branched alkyl alcohol. Even more preferably, the branched alkyl alcohol and the dialkyl adipate ester have at least about 20% of the carbons in the form of methyl groups. Even more preferably, the branched alcohol and the dialkyl adipate ester have at least about 25% of the carbons in the form of methyl groups. Even more preferably, the branched alcohol and the dialkyl adipate ester have at least about 30% of the carbons in the form of methyl groups. Most preferably, the branched alcohol and the dialkyl adipate ester have at least about 50% of the carbons in the form of methyl groups.

The dialkyl adipate ester can preferably be used in mixture with one or more hydrocarbon base oils described herein. Illustrative mixtures include, for example, diisobutyl adipate/hydrogenated polyisobutene (80/20), diisobutyl adipate/hydrogenated polyisobutene (60/40), diisobutyl adipate/hydrogenated polyisobutene (40/60), diisobutyl adipate/hydrogenated polyisobutene (20/80), diisobutyl adipate/isoeicosane (80/20), diisobutyl adipate/isoeicosane (60/40), diisobutyl adipate/isoeicosane (40/60), diisobutyl adipate/isoeicosane (20/80), and the like.

When the dialkyl adipate ester is used in mixture with a hydrocarbon base oil, the weight ratio of dialkyl adipate ester:hydrocarbon base oil can range from about 1:99 to about 99:1, or from about 5:95 to about 95:5, or from about 10:90 to about 90:10, or from about 25:75 to about 75:25, or intermediate ratios. The weight ratio can also be 50:50. This ratio can be adjusted to reach a certain solubility for an additive or to reach a certain viscosity.

Other ester base oils useful in this disclosure include, for example, mono-esters and more preferably mono-esters of branched alkyl acids and branched alcohols such as isopropyl isohexadodecanoate, isopropyl isooctadecanoate, isobutyl isononanoate, isobutyl isodecanoate, isobutyl neodecanoate, isobutyl isododecanoate, isobutyl isotridecanoate, isobutyl isotetradecanoate, isobutyl isohexadecanoate, isobutyl isooctadecanoate, isopental isononanoate, isopentyl isodecanoate, isopentyl neodecanoate, isopentyl isododecanoate, isopentyl isotridecanoate, isopentyl isotetradecanoate, isopentyl isohexadecanoate, isopentyl isooctadecanoate, neopental isononanoate, neopentyl isodecanoate, neopentyl neodecanoate, neopentyl isododecanoate, neopentyl isotridecanoate, neopentyl isotetradecanoate, neopentyl isohexadecanoate, neopentyl isooctadecanoate, isohexyl isononanoate, isohexyl isodecanoate, isohexyl neodecanoate, isohexyl isododecanoate, isohexyl isotridecanoate, isohexyl isotetradecanoate, isohexyl isohexadecanoate, isohexyl isooctadecanoate, isoheptanol isononanoate, isoheptanol isodecanoate, isoheptanol neodecanoate, isoheptanol isododecanoate, isoheptanol isotridecanoate, isoheptanol isotetradecanoate, isoheptanol isohexadecanoate, isoheptanol isooctadecanoate, isooctyl isononanoate, isooctyl isodecanoate, isooctyl neodecanoate, isooctyl isododecanoate, isooctyl isotridecanoate, isooctyl isotetradecanoate, isooctyl isohexadecanoate, isooctyl isooctadecanoate, isononyl isononanoate, isononyl isodecanoate, isononyl neodecanoate, isononyl isododecanoate, isononyl isotridecanoate, isononyl isotetradecanoate, isononyl isohexadecanoate, isononyl isooctadecanoate, isodecyl isononanoate, isodecyl isodecanoate, isodecyl neodecanoate, isodecyl isododecanoate, isodecyl isotridecanoate, isodecyl isotetradecanoate, isodecyl isohexadecanoate, isodecyl isooctadecanoate, neodecyl isononanoate, neodecyl isodecanoate, neodecyl neodecanoate, neodecyl isododecanoate, neodecyl isotridecanoate, neodecyl isotetradecanoate, neodecyl isohexadecanoate, neodecyl isooctadecanoate, isododecyl neopentanoate, isododecyl isooctanoate, isododecyl isononanoate, isododecyl isodecanoate, isododecyl neodecanoate, isododecyl isododecanoate, isododecyl isotridecanoate, isododecyl isotetradecanoate, isododecyl to isohexadecanoate, isododecyl isooctadecanoate, isotridecyl neopentanoate, isotridecyl isooctanoate, isotridecyl isononanoate, isotridecyl isodecanoate, isotridecyl neodecanoate, isotridecyl isododecanoate, isotridecyl isotridecanoate, isotridecyl isotetradecanoate, isotridecyl isohexadecanoate, isotridecyl isooctadecanoate, isotetradecyl neopentanoate, isotetradecyl isooctanoate, isotetradecyl isononanoate, isotetradecyl isodecanoate, isotetradecyl neodecanoate, isotetradecyl isododecanoate, isotetradecyl isotridecanoate, isotetradecyl isotetradecanoate, isotetradecyl isohexadecanoate, isotetradecyl isooctadecanoate, isohexadecyl isobutanoate, isohexadeyl neopentanoate, isohexadeyl isooctanoate, isohexydecyl isononanoate, isohexadecyl isodecanoate, isohexadecyl neodecanoate, isohexadecyl isododecanoate, isohexadecyl isotridecanoate, isohexadecyl isotetradecanoate, isohexadecyl isohexadecanoate, isohexadecyl isooctadecanoate, isohexadecyl isononanoate, isohexadecyl isodecanoate, isohexadecyl neodecanoate, isohexadecyl isododecanoate, isohexadecyl isotridecanoate, isohexadecyl isohexadecanoate, isohexadecyl isohexadecanoate, isohexadecyl isooctadecanoate, isooctadecyl isobutanoate, isooctadeyl neopentanoate, isooctadeyl isooctanoate, isooctadecyl isononanoate, isooctadecyl isodecanoate, isooctadecyl neodecanoate, isooctadecyl isododecanoate, isooctadecyl isotridecanoate, isooctadecyl isotetradecanoate, isooctadecyl isohexadecanoate, isohexadecyl isooctadecanoate, or their mixtures.

Particularly useful branched mono-carboxylic acids include, for example, 2,2-dimethyl propionic acid (neopentanoic acid), neoheptanoic acid, neooctanoic acid, neononanoic acid, iso-hexanoic acid, neodecanoic acid, 2-ethyl hexanoic acid (2EH), 3,5,5-trimethyl hexanoic acid (TMH), isoheptanoic acid, isooctanoic acid, isononanoic acid, isodecanoic acid, isotetradecanoic acid, isohexadecanoic (isopalmitic acid), isooctadecanoic acid (isostearic acid), or mixtures of any of these materials. One especially preferred branched acid is 3,5,5-trimethyl hexanoic acid. The term "neo" as used herein refers to a trialkyl acetic acid, i.e., an acid which is triply substituted at the alpha carbon with alkyl groups.

Particularly useful branched mono-alcohols include, for example, 2,2-dimethyl propanol (neopentanol), neoheptanol, neooctanol, neononanol, neo-hexanol, neodecanol, 2-ethyl hexanol (2EH), 3,5,5-trimethyl hexanol, isoheptanol, isononanol, isodecanol, isododecanol, isotridecanol, isotetradecanol, isohexadecanol, isooctadecanol (isostearyl alcohol), or mixtures of any of these materials. One especially preferred branched alcohol is 3,5,5-trimethyl hexanol. The term "neo" as used herein refers to a trialkyl ethanol, i.e., an alcohol which is triply substituted at the alpha carbon with alkyl groups.

It is further preferred that the branched alkyl acid or the branched alkyl alcohol is derived from a renewable source.

Preferably, the branched alkyl alcohol and the branched alkyl acid have at least about 20% of the carbons in the form of methyl groups. Even more preferably, the branched alcohol and the branched alkyl acid have at least about 25% of the carbons in the form of methyl groups. Even more preferably, the branched alcohol and the branched alkyl acid have at least about 30% of the carbons in the form of methyl groups. Most preferably, the branched alcohol and branched alkyl acid have at least about 50% of the carbons in the form of methyl groups.

The mono-ester derived from a branched alkyl acid and a branched alkyl alcohol can preferably be used in mixture with one or more hydrocarbon base oils described herein. Illustrative mixtures include, for example, isononyl isononanoate/hydrogenated polyisobutene (80/20), isononyl isononanoate/hydrogenated polyisobutene (60/40), isononyl isononanoate/hydrogenated polyisobutene (40/60), isononyl isononanoate/hydrogenated polyisobutene (20/80), isononyl isononanoate/hydrogenated polyisobutene (80/20), isononyl isononanoate/hydrogenated polyisobutene (60/40), isononyl isononanoate/isoeicosane (40/60), isononyl isononanoate/isoeicosane (20/80), and the like.

When the mono-ester derived from a branched alkyl acid and a branched alkyl alcohol is used in mixture with a hydrocarbon base oil, the weight ratio of dialkyl adipate ester:hydrocarbon base oil can range from about 1:99 to about 99:1, or from about 5:95 to about 95:5, or from about 10:90 to about 90:10, or from about 25:75 to about 75:25, or intermediate ratios. The weight ratio can also be 50:50. This ratio can be adjusted to reach a certain solubility for an additive or to reach a certain viscosity.

Engine oil formulations containing renewable esters are included in this disclosure. For such formulations, the renewable content of the ester is typically greater than about 70 weight percent, preferably more than about 80 weight percent and most preferably more than about 90 weight percent.

The ester can be present in an amount of from about 1 to about 100 weight percent, or from about 5 to about 95 weight percent, or from about 10 to about 90 weight percent, or from about 20 to about 80 weight percent, based on the total weight of the formulated oil.

When the ester is used as a cobase stock, the lubricating oil base stock is present in an amount of from about 70 weight percent to about 95 weight percent, and the polyol ester is present in an amount from about 1.0 to about 40 weight percent, based on the total weight of the lubricating oil.

Other Additives

The formulated lubricating oil useful in the present disclosure may additionally contain one or more of the other commonly used lubricating oil performance additives including but not limited to antiwear agents, dispersants, other detergents, corrosion inhibitors, rust inhibitors, metal deactivators, extreme pressure additives, anti-seizure agents, wax modifiers, viscosity index improvers, viscosity modifiers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973); see also U.S. Pat. No. 7,704,930, the disclosure of which is incorporated herein in its entirety. These additives are commonly delivered with varying amounts of diluent oil, that may range from 5 weight percent to 50 weight percent.

The types and quantities of performance additives used in combination with the instant disclosure in lubricant compositions are not limited by the examples shown herein as illustrations.

Detergents

Illustrative detergents useful in this disclosure include, for example, alkali metal detergents, alkaline earth metal detergents, or mixtures of one or more alkali metal detergents and one or more alkaline earth metal detergents. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased. These detergents can be used in mixtures of neutral, overbased, highly overbased calcium salicylate, sulfonates, phenates and/or magnesium salicylate, sulfonates, phenates. The TBN ranges can vary from low, medium to high TBN products, including as low as 0 to as high as 600. Mixtures of low, medium, high TBN can be used, along with mixtures of calcium and magnesium metal based detergents, and including sulfonates, phenates, salicylates, and carboxylates. A detergent mixture with a metal ratio of 1, in conjunction of a detergent with a metal ratio of 2, and as high as a detergent with a metal ratio of 5, can be used. Borated detergents can also be used.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$ or mixtures thereof. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched and can be used from 0.5 to 6 weight percent. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

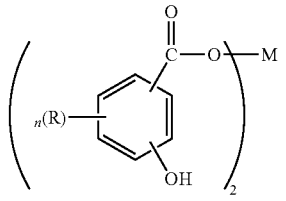

where R is an alkyl group having 1 to 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents and are known in the art.

Detergents may be simple detergents or what is known as hybrid or complex detergents. The latter detergents can provide the properties of two detergents without the need to blend separate materials. See U.S. Pat. No. 6,034,039.

Preferred detergents include calcium phenates, calcium sulfonates, calcium salicylates, magnesium phenates, magnesium sulfonates, magnesium salicylates and other related components (including borated detergents), and mixtures thereof. Preferred mixtures of detergents include magnesium sulfonate and calcium salicylate, magnesium sulfonate and calcium sulfonate, magnesium sulfonate and calcium phenate, calcium phenate and calcium salicylate, calcium phenate and calcium sulfonate, calcium phenate and magnesium salicylate, calcium phenate and magnesium phenate.

Another family of detergents is oil soluble ashless non-ionic detergent. Typical non-ionic detergents are polyoxyethylene, polyoxypropylene, or polyoxybutylene alkyl ethers. For reference, see "Nonionic Surfactants: Physical Chemistry" Martin J. Schick, CRC Press; 2 edition (Mar. 27, 1987). These detergents are less common in engine lubricant formulations, but offer a number of advantages such as improved solubility in ester base oils.

The preferred detergents in this disclosure include detergents soluble in a polyol ester, preferably a mono- or dipentaerythritol ester of at least one branched mono carboxylic acid, and more preferably the detergent is an ashless non-ionic detergent. Most preferably, the detergents in this disclosure is an ashless nonionic detergent with a Hydrophilic-Lipophilic Balance (HLB) value of 10 or below. These detergents are commercially available from for example, Croda Inc., under the trade designations "Alarmol PS11E" and "Alarmol PS15E", from for example the Dow Chemical Co. the trade designation "Ecosurf EH-3", "Tergitol 15-S-3", "Tergitol L-61", "Tergitol L-62", "Tergitol NP-4", "Tergitol NP-6", "Tergitol NP-7", "Tergitol NP-8", "Tergitol NP-9", "Triton X-15", and "Triton X-35".

The detergent concentration in the lubricating oils of this disclosure can range from 0.5 to 6.0 weight percent, preferably 0.6 to 5.0 weight percent, and more preferably from 0.8 weight percent to 4.0 weight percent, based on the total weight of the lubricating oil.

As used herein, the detergent concentrations are given on an "as delivered" basis. Typically, the active detergent is delivered with a process oil. The "as delivered" detergent typically contains from 20 weight percent to 100 weight percent, or from 40 weight percent to 60 weight percent, of active detergent in the "as delivered" detergent product.

Dispersants

During engine operation, oil-insoluble oxidation byproducts are produced. Dispersants help keep these byproducts in solution, thus diminishing their deposition on metal surfaces. Dispersants used in the formulation of the lubricating oil may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,215,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful, although on occasion, having a hydrocarbon substituent between 20-50 carbon atoms can be useful.

Succinimides are formed by the condensation reaction between hydrocarbyl substituted succinic anhydrides and amines. Molar ratios can vary depending on the polyamine. For example, the molar ratio of hydrocarbyl substituted succinic anhydride to TEPA can vary from 1:1 to 5:1. Representative examples are shown in U.S. Pat. Nos. 3,087,936; 3,172,892; 3,219,666; 3,272,746; 3,322,670; and 3,652,616, 3,948,800; and Canada Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs will typically range between 800 and 2,500 or more. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from 0.1 to 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or $HNR_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from 500 to 5000, or from 1000 to 3000, or 1000 to 2000, or a mixture of such hydrocarbylene groups, often with high terminal vinylic groups. Other preferred dispersants include succinic acid-esters and amides, alkylphenol-polyamine-coupled Mannich adducts, their capped derivatives, and other related components.

Polymethacrylate or polyacrylate derivatives are another class of dispersants. These dispersants are typically prepared by reacting a nitrogen containing monomer and a methacrylic or acrylic acid esters containing 5-25 carbon atoms in the ester group. Representative examples are shown in U.S. Pat. Nos. 2,100,993, and 6,323,164. Polymethacrylate and polyacrylate dispersants are normally used as multifunctional viscosity index improvers. The lower molecular weight versions can be used as lubricant dispersants or fuel detergents.

The use of polymethacrylate or polyacrylate dispersants are preferred in polar esters of a non-aromatic dicarboxylic acid, preferably adipate esters, since many other conventional dispersants are less soluble. The preferred dispersants for polyol esters in this disclosure include polymethacrylate and polyacrylate dispersants.

Such dispersants may be used in an amount of 0.1 to 20 weight percent, preferably 0.5 to 8 weight percent, or more preferably 0.5 to 4 weight percent. The hydrocarbon numbers of the dispersant atoms can range from C60 to C1000, or from C70 to C300, or from C70 to C200. These dispersants may contain both neutral and basic nitrogen, and mixtures of both. Dispersants can be end-capped by borates and/or cyclic carbonates.

Antiwear Agent

A metal alkylthiophosphate and more particularly a metal dialkyl dithio phosphate in which the metal constituent is zinc, or zinc dialkyl dithio phosphate (ZDDP) is a useful component of the lubricating oils of this disclosure. ZDDP can be derived from primary alcohols, secondary alcohols or mixtures thereof. ZDDP compounds generally are of the formula $$Zn[SP(S)(OR^1)(OR^2)]_2$$

where $R^1$ and $R^2$ are $C_1$-$C_{18}$ alkyl groups, preferably $C_2$-$C_{12}$ alkyl groups. These alkyl groups may be straight chain or branched. Alcohols used in the ZDDP can be 2-propanol, butanol, secondary butanol, pentanols, hexanols such as 4-methyl-2-pentanol, n-hexanol, n-octanol, 2-ethyl hexanol, alkylated phenols, and the like. Mixtures of secondary alcohols or of primary and secondary alcohol can be preferred. Alkyl aryl groups may also be used.

Preferable zinc dithiophosphates which are commercially available include secondary zinc dithiophosphates such as those available from for example, The Lubrizol Corporation under the trade designations "LZ 677A", "LZ 1095" and "LZ 1371", from for example Chevron Oronite under the trade designation "OLOA 262" and from for example Afton Chemical under the trade designation "HITEC 7169".

ZDDP is typically used in amounts of from 0.4 weight percent to 1.2 weight percent, preferably from 0.5 weight percent to 1.0 weight percent, and more preferably from 0.6 weight percent to 0.8 weight percent, based on the total weight of the lubricating oil, although more or less can often be used advantageously. Preferably, the ZDDP is a secondary ZDDP and present in an amount of from 0.6 to 1.0 weight percent of the total weight of the lubricating oil.

Low phosphorus engine oil formulations are included in this disclosure. For such formulations, the phosphorus content is typically less than 0.12 weight percent preferably less than 0.10 weight percent, and most preferably less than 0.085 weight percent. Low phosphorus can be preferred in combination with the friction modifier.

Viscosity Index Improvers

Viscosity index improvers (also known as VI improvers, viscosity modifiers, and viscosity improvers) can be included in the lubricant compositions of this disclosure.

Viscosity index improvers provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between about 10,000 to 1,500,000, more typically about 20,000 to 1,200,000, and even more typically between about 50,000 and 1,000,000. The typical molecular weight for polymethacrylate or polyacrylate viscosity index improvers is less than about 50,000.

Examples of suitable viscosity index improvers are linear or star-shaped polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers, are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Hydrogenated polyisoprene star polymers are commercially available from Infineum International Limited, e.g., under the trade designation "SV200" and "SV600". Hydrogenated diene-styrene block copolymers are commercially available from Infineum International Limited, e.g., under the trade designation "SV 50".

The preferred viscosity index improvers in this disclosure when an ester of a non-aromatic dicarboxylic acid, preferably an alkyl adipate ester, is used as base oil, are polymethacrylate or polyacrylate polymers, including dispersant polymethacrylate and dispersant polyacrylate polymers. These polymers offer significant advantages in solubility in esters of a non-aromatic dicarboxylic acid, preferably alkyl adipate esters. The polymethacrylate or polyacrylate polymers can be linear polymers which are available from Evnoik Industries under the trade designation "Viscoplex®" (e.g., Viscoplex 6-954) or star polymers which are available from Lubrizol Corporation under the trade designation Asteric™ (e.g., Lubrizol 87708 and Lubrizol 87725).

In an embodiment of this disclosure, the viscosity index improvers may be used in an amount of from 1.0 to about 20% weight percent, preferably 5 to about 15 weight percent, and more preferably 8.0 to about 12 weight percent, based on the total weight of the formulated oil or lubricating engine oil.

As used herein, the viscosity index improver concentrations are given on an "as delivered" basis. Typically, the active polymer is delivered with a diluent oil. The "as delivered" viscosity index improver typically contains from 20 weight percent to 75 weight percent of an active polymer for polymethacrylate or polyacrylate polymers, or from 8 weight percent to 20 weight percent of an active polymer for olefin copolymers, hydrogenated polyisoprene star polymers, or hydrogenated diene-styrene block copolymers, in the "as delivered" polymer concentrate.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant disclosure. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants are more fully described in U.S. Pat. No. 8,048,833, herein incorporated by reference in its entirety.

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to 20 carbon atoms, and preferably contains from 6 to 12 carbon atoms. The aliphatic group is an aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least 6 carbon atoms. Examples of aliphatic groups include hexyl, heptyl, octyl, nonyl, and decyl. Generally, the aliphatic groups will not contain more than 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alphanaphthylamine; phenyl-alphanaphthylamine; and p-octylphenyl-alphanaphthylamine.

Sulfurized alkyl phenols and alkali or alkaline earth metal salts thereof also are useful antioxidants.

Preferred antioxidants include hindered phenols, arylamines. These antioxidants may be used individually by type or in combination with one another. Such additives may be used in an amount of 0.01 to 5 weight percent, preferably 0.01 to 1.5 weight percent, more preferably zero to less than 1.5 weight percent, more preferably zero to less than 1 weight percent.

Pour Point Depressants (PPDs)

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of about 0.01 to 5 weight percent, preferably about 0.01 to 1.5 weight percent.

Seal Compatibility Agents

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 weight percent, preferably about 0.01 to 2 weight percent.

Antifoam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 weight percent and often less than 0.1 weight percent.

Inhibitors and Antirust Additives

Antirust additives (or corrosion inhibitors) are additives that protect lubricated metal surfaces against chemical attack by water or other contaminants. A wide variety of these are commercially available.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 weight percent, preferably about 0.01 to 1.5 weight percent.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure.

Illustrative friction modifiers may include, for example, organometallic compounds or materials, or mixtures thereof. Illustrative organometallic friction modifiers useful in the lubricating engine oil formulations of this disclosure include, for example, molybdenum amine, molybdenum diamine, an organotungstenate, a molybdenum dithiocarbamate, molybdenum dithiophosphates, molybdenum amine complexes, molybdenum carboxylates, and the like, and mixtures thereof. Similar tungsten based compounds may be preferable.

Other illustrative friction modifiers useful in the lubricating engine oil formulations of this disclosure include, for example, alkoxylated fatty acid esters, alkanolamides, polyol fatty acid esters, borated glycerol fatty acid esters, fatty alcohol ethers, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isostearate, polyoxypropylene isostearate, polyoxyethylene palmitate, and the like.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, polypropoxylated hydrocarbylamides, and the like.

Illustrative polyol fatty acid esters include, for example, glycerol mono-oleate, saturated mono-, di-, and tri-glyceride esters, glycerol mono-stearate, and the like. These can include polyol esters, hydroxyl-containing polyol esters, and the like.

Illustrative borated glycerol fatty acid esters include, for example, borated glycerol mono-oleate, borated saturated mono-, di-, and tri-glyceride esters, borated glycerol monosterate, and the like. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Preferred can be the glycerol monooleates, glycerol dioleates, glycerol trioleates, glycerol monostearates, glycerol distearates, and glycerol tristearates and the corresponding glycerol monopalmitates, glycerol dipalmitates, and glycerol tripalmitates, and the respective isostearates, linoleates, and the like. On occasion the glycerol esters can be preferred as well as mixtures containing any of these. Ethoxylated, propoxylated, butoxylated fatty acid esters of polyols, especially using glycerol as underlying polyol can be preferred.

Illustrative fatty alcohol ethers include, for example, stearyl ether, myristyl ether, and the like. Alcohols, including those that have carbon numbers from C3 to C5, can be ethoxylated, propoxylate, or butoxylated to form the corresponding fatty alkyl ethers. The underlying alcohol portion can preferably be stearyl, myristyl, C11-C13 hydrocarbon, oleyl, isosteryl, and the like.

Useful concentrations of friction modifiers may range from 0.01 weight percent to 5 weight percent, or about 0.1 weight percent to about 2.5 weight percent, or about 0.1 weight percent to about 1.5 weight percent, or about 0.1 weight percent to about 1 weight percent. Concentrations of molybdenum-containing materials are often described in terms of Mo metal concentration. Advantageous concentrations of Mo may range from 25 ppm to 2000 ppm or more, and often with a preferred range of 50-1500 ppm. Friction modifiers of all types may be used alone or in mixtures with the materials of this disclosure. Often mixtures of two or more friction modifiers, or mixtures of friction modifier(s) with alternate surface active material(s), are also desirable.

When lubricating oil compositions contain one or more of the additives discussed above, the additive(s) are blended into the composition in an amount sufficient for it to perform its intended function. Typical amounts of such additives useful in the present disclosure are shown in Table 1 below.

It is noted that many of the additives are shipped from the additive manufacturer as a concentrate, containing one or more additives together, with a certain amount of base oil diluents. Accordingly, the weight amounts in the table below, as well as other amounts mentioned herein, are directed to the amount of active ingredient (that is the non-diluent portion of the ingredient). The weight percent (wt %) indicated below is based on the total weight of the lubricating oil composition.

TABLE 1

Typical Amounts of Other Lubricating Oil Components

| Compound | Approximate wt % (Useful) | Approximate wt % (Preferred) |
|---|---|---|
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Index Improver (pure polymer basis) | 0.0-8 | 0.1-6 |
| Anti-wear | 0.1-2 | 0.5-1 |
| Inhibitor and Antirust | 0.01-5 | 0.01-1.5 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

Fuel Formulations

The present disclosure also provides fuel additive compositions for use in a gasoline fuel composition. The fuel additive compositions contain at least one branched hydrocarbon having at least about 25% of the carbons in the form of methyl groups, or at least one polyol ester. The branched hydrocarbon preferably comprises at least one poly (branched alkene) or at least one branched alkane or at least one branched alkene. The preferred poly(branched alkene) is polyisobutene or hydrogenated polyisobutene. The preferred branched alkane is isoeicosane. The preferred branched alkene is squalene. The preferred polyol ester is a mono-pentaerythritol ester of at least one branched mono-carboxylic acid, a di-pentaerythritol ester of at least one branched mono-carboxylic acid, having at least about 25% of the total carbons in the form of methyl groups.

The poly(branched alkene) polymers useful in the fuel additive compositions of this disclosure are described herein. Preferably, the poly(branched alkene) polymers have at least about 25% of the carbons in the form of methyl groups. Even more preferably, the poly(branched alkene) polymers have at least about 35% of the carbons in the form of methyl groups. Even more preferably, the poly(branched alkene) polymers have at least about 40% of the carbons in the form of methyl groups. Most preferably, the poly (branched alkene) polymers have at least about 50% of the carbons in the form of methyl groups.

The branched alkanes useful in the fuel additive compositions of this disclosure are described herein. Preferably, the branched alkanes have at least about 20% of the carbons in the form of methyl groups. Even more preferably, the branched alkanes have at least about 25% of the carbons in the form of methyl groups. Even more preferably, the branched alkanes have at least about 30% of the carbons in the form of methyl groups. Most preferably, the branched alkanes have at least about 50% of the carbons in the form of methyl groups.

The branched alkenes useful in the fuel additive compositions of this disclosure are described herein. Preferably, the branched alkenes have at least about 20% of the carbons in the form of methyl groups. Even more preferably, the branched alkenes have at least about 25% of the carbons in the form of methyl groups. Even more preferably, the branched alkenes have at least about 30% of the carbons in the form of methyl groups. Most preferably, the branched alkenes have at least about 50% of the carbons in the form of methyl groups.

The polyol esters useful in the fuel additive compositions of this disclosure are described herein. Preferably, the polyol esters are derived from a polyhydric alcohol and at least one branched carboxylic acid. Even more preferably, the branched mono-carboxylic acid and the polyol ester have at least about 25% of the carbons in the form of methyl groups. Even more preferably, the branched monocarboxylic acid and the polyol ester have at least about 35% of the carbons in the form of methyl groups. Even more preferably, the branched mono-carboxylic acid and the polyol ester have at least about 40% of the carbons in the form of methyl groups. Most preferably, the branched mono-carboxylic acid and the polyol ester have at least about 50% of the carbons in the form of methyl groups.

For gasoline fuel compositions, a preferred fuel additive formulation comprises from about 20 to about 100 weight percent, more preferably from about 20 to about 80 weight percent, and most preferably from about 50 to about 80 weight percent, of at least one branched hydrocarbon, at least one polyol ester of a mono-carboxylic acid, and mixtures thereof. The preferred fuel additive compositions of this disclosure further comprise at least one of polyisobutene or hydrogenated polyisobutene, isoeicosane, squalene, a mono-pentaerythritol ester of a single or mixed branched carboxylic acids, a di-pentaerythritol ester of a single or mixed branched carboxylic acids, in an amount from about 60 to about 80 weight percent, based on the weight of the fuel additive composition.

The fuel additive compositions of the present disclosure can be blended with either gasoline as needed for different types of spark ignition engines. The fuel additive composition is added in an amount sufficient to produce a fuel additive: gasoline fuel volume ratio of greater than about 1:1000, preferably between about 1:100 and 1:5.

The gasoline fuel compositions of this disclosure for use in an internal combustion engine comprise gasoline fuel and a fuel additive composition comprising at least one branched hydrocarbon, at least one polyol ester of at least one mono-carboxylic acid, and mixtures thereof, preferably at least one of polyisobutene or hydrogenated polyisobutene, isoeicosane, squalene, a mono-pentaerythritol ester of at least one branched mono-carboxylic acid, a di-pentaerythritol ester of at least one branched monocarboxylic acid. The combustion delay of the mixture containing isooctane and 5% ester is preferably higher than 90% of the isooctane ignition delay, more preferably, the ignition delay of the mixture containing isooctane and ester is similar or higher than the isooctane ignition delay.

The following non-limiting examples are provided to illustrate the disclosure.

EXAMPLES

Example 1

Formulations were prepared as described in FIG. 1. All of the ingredients used are commercially available. The base oils used in the formulations included a diisobutyl adipate base oil (Base Oil 1), a mono-pentaerythritol ester of branched acids base oil (Base Oil 2), a dipentaerythritol ester of branched acids base oil (Base Oil 3), a hydrogenated polyisobutene base oil (Base Oil 4), a hydrogenated polyisobutene base oil Mn 1300 (Base Oil 5), a polyisobutene base oil Mn 440 (Base Oil 6), a squalene base oil (Base Oil 7), an isoeicosane base oil (Base Oil 8), a diisooctyl adipate base oil (Base Oil 9), a di-pentaerythritol ester of branched acids base oil (Base Oil 10), a dihexyl adipate base oil (Base Oil 11), a diisobutyl azelate base oil (Base Oil 12), a diisodecyl adipate base oil (Base Oil 13), a pentaerythritol ester of branched acids base oil (Base Oil 14), a diisodecyl phthalate base oil (Base Oil 15), a triisononyl trimellitate base oil (Base Oil 16), an isononyl heptanoate base oil (Base Oil 17), a di-pentaerythritol ester of branched acids base oil (Base Oil 18), a di-pentaerythritol ester of branched acids base oil (Base Oil 19), a dibutyl sebacate base oil (Base Oil 20), an isodecyl pelargonate base oil (Base Oil 21), a dioctyl sebacate base oil (Base Oil 22), a mono-pentaerythritol ester base oil (Base Oil 23), a squalene base oil (Base Oil 24), a trimethylolpropane ester of C8-C10 acids base oil (Base Oil 25), an alkyl naphthalene base oil (Base Oil 26), a 2-ethylhexyl laurate base oil (Base Oil 27), a decene dimer base oil (Base Oil 28), an ethyl hexyl palmitate base oil (Base Oil 29), a decene trimer base oil (Base Oil 30), a gas-to-liquid base stock 4 cSt (Base Oil 31), a Group III base stock 4 cSt (Base Oil 32), a Group II+ base stock 4.5 cSt (Base Oil 33), a polyalkylene glycol base oil (Base Oil 34), a polyalkylene glycol base oil (Base Oil 35), and a PPG-15 stearyl ether base oil (Base Oil 36). Isooctane, a standard reference fuel for combustion in gasoline engine (Octane level 100), was used as a diluent to which the lubricant base oils were tested.

A Herzogs Cetane ID 510 analyzer was used to measure ignition delay and combustion delay using a constant volume combustion chamber. Equipment setting and operating conditions are based on ASTM D7668-14a. The results are reported as relative values normalized to the latest pure isooctane data. Isooctane, a standard reference fuel for combustion in gasoline engine (Octane level 100), was used as a diluent to which the lubricant base oil, lubricant base oil mixtures, and lubricant formulations were tested. Pure isooctane data were generated periodically. In this test, a function of ignition and combustion delay times correlates with cetane number of diesel fuel, which is known to be inversely proportional to the octane number of gasoline fuel. Longer ignition and combustion delays when compared to isooctane are desirable for a gasoline engine. "Relative ignition delay" is the ignition delay of the blend, divided by the ignition delay of isooctane and has no units. "Relative combustion delay" is the combustion delay of the blend, divided by the combustion delay of isooctane and also has no units.

Relative ignition delay data (normalized to isooctane) generated from the Herzogs Cetane ID 510 analyzer testing of the various lubricant base oils in isooctane are given in FIG. 1.

Relative combustion delay data (normalized to isooctane) generated from the Herzogs Cetane ID 510 analyzer testing of the various lubricant base oils in isooctane are given in FIG. 2.

Example 2

Formulations containing mixtures of base oils were prepared as described in FIGS. 3 and 4. All of the ingredients used are commercially available. The base oils used in the formulations included a diisobutyl adipate base oil (Base Oil 1), a hydrogenated polyisobutene base oil (Base Oil 4), and an isoeicosane base oil (Base Oil 8).

Relative ignition delay data (normalized to isooctane) generated from the Herzogs Cetane ID 510 analyzer testing of the various lubricant base oil mixtures in isooctane are given in FIG. 3.

Relative combustion delay data (normalized to isooctane) generated from the Herzogs Cetane ID 510 analyzer testing of the various lubricant base oil mixtures in isooctane are given in FIG. 4.

Example 3

The relationship between percentages of carbons in the forms of quaternary carbons, CH, CH2, and CH3 and the relative combustion delay (normalized to isooctane), as determined from the Herzogs Cetane ID 510 analyzer testing, for branched hydrocarbons is shown in FIG. 5. All of the ingredients used are commercially available. The base oils used in the formulations included a decene dimer base oil (Base Oil 28), a decene trimer base oil (Base Oil 30), a squalene base oil (Base Oil 24), and an isoeicosane base oil (Base Oil 8). Other base oils used in the formulations included a hydrogenated polyisobutene base oil (Base Oil 4), a hydrogenated polyisobutene base oil Mn 1300 (Base Oil 5), a polyisobutene base oil Mn 440 (Base Oil 6), and a squalene base oil (Base Oil 7). Isooctane, a standard reference fuel for combustion in gasoline engine (Octane level 100), was used as a diluent to which the lubricant base oils were tested.

Example 4

The relationship between percentages of carbons in the forms of quaternary carbons, CH, CH2, and CH3 and the relative combustion delay (normalized to isooctane), as determined from the Herzogs Cetane ID 510 analyzer testing, for selected polyol esters is shown in FIG. 6. All of the ingredients used are commercially available. The base oils used in the formulations included a mono-pentaerythritol ester base oil (Base Oil 23), a di-pentaerythritol ester of branched acids base oil (Base Oil 19), a di-pentaerythritol ester of branched acids base oil (Base Oil 18), a mono-pentaerythritol ester of branched acids base oil (Base Oil 2), and a di-pentaerythritol ester of branched acids base oil (Base Oil 10). Isooctane, a standard reference fuel for combustion in gasoline engine (Octane level 100), was used as a diluent to which the lubricant base oils were tested.

Example 5

A lubricant component solubility test was conducted. Various additive components identified in FIG. 7 were added to Base Oil 2, Base Oil 1 and a 50:50 blend of Base Oil 1:Base Oil 4 and mixed at a temperature of 60° C. for a period of 1 hour. The solubility was determined based on visual observation after the mixture was cooled down to room temperature. The results of the lubricant component solubility test are set forth in FIG. 7.

Example 6

Formulations were prepared as described in FIG. 8. All of the ingredients used herein are commercially available. A mono-pentaerythritol ester of branched acids base oil (Base Oil 2), a di-pentaerythritol ester of branched acids base oil (Base Oil 10), a diisobutyl adipate base oil (Base Oil 1), or a hydrogenated polyisobutene base oil (Base Oil 4) were used in the formulations.

The antiwear agents used in the formulations were ZDDP derived from a secondary alcohol and ZDDP derived from a primary alcohol. The remaining ingredients used in the formulations were one or more of a viscosity index improver, antioxidant, overbased detergent, dispersant, pour point depressant, corrosion inhibitor, metal deactivator, seal compatibility additive, anti-foam agent, inhibitor, anti-rust additive, viscosity modifier, and friction modifier (ashless). Molybdenum dithiophosphate was also used.

Testing was conducted for formulations described in FIG. 8. The results are set forth in FIG. 8. Sulfated ash testing was determined in accordance with ASTM D874. Zinc, phosphorus, molybdenum, magnesium and boron content were determined in accordance with ASTM D4951. Specific gravity testing was determined in accordance with ASTM D4052. Kinematic viscosity testing at 40° C., 100° C. and 150° C. was determined in accordance with ASTM D445. Apparent viscosity testing was determined in accordance with ASTM D4683 at 150° C.

Relative ignition delay data (normalized to isooctane) generated from the Herzogs Cetane ID 510 analyzer testing of the various lubricant base oils in isooctane are given in FIG. 8.

Relative combustion delay data (normalized to isooctane) generated from the Herzogs Cetane ID 510 analyzer testing of the various lubricant base oils in isooctane are given in FIG. 8.

PCT and EP Clauses:

1. A method for preventing or reducing engine knock or pre-ignition in a high compression spark ignition engine lubricated with a lubricating oil by using as the lubricating oil a formulated oil including a Group I, Group II, Group III, Group IV, Group V base oil, or mixtures thereof, said formulated oil having a composition comprising at least one branched hydrocarbon having at least 25% of the carbons in the form of methyl groups or at least one branched polyol ester.

2. The method of clause 1 wherein the at least one branched hydrocarbon comprises at least one poly(branched alkene) or at least one branched alkane or at least one branched alkene.

3. The method of clause 2 wherein the at least one poly(branched alkene) comprises polyisobutene or hydrogenated polyisobutene.

4. The method of clauses 1-3 wherein the at least one branched hydrocarbon has at least 20% of the carbons in the form of quaternary carbons.

5. The method of clause 1 wherein the at least one branched polyol ester has at least 25% of the carbons in the form of methyl groups.

6. The method of clause 1 or 5 wherein the at least one branched polyol ester has at least 20% of the carbons in the form of quaternary carbons.

7. The method of clauses 1 or 5-6 wherein the at least one branched polyol ester is derived from at least one polyhydric alcohol and at least one branched mono-carboxylic acid.

8. The method of clause 7 wherein the polyhydric alcohol is selected from the group consisting of neopentyl glycol, 2,2-dimethylol butane, trimethylol ethane, trimethylol propane, trimethylol butane, pentaerythritol, mono-pentaerythritol, di-pentaerythritol, tri-pentaerythritol, ethylene glycol, propylene glycol polyalkylene glycols, and mixtures thereof.

9. The method of clauses 7-8 wherein the branched mono-carboxylic acid is selected from the group consisting of 2,2-dimethyl propionic acid (neopentanoic acid), neoheptanoic acid, neooctanoic acid, neononanoic acid, isohexanoic acid, neodecanoic acid, 2-ethyl hexanoic acid (2EH), 3,5,5-trimethyl hexanoic acid (TMH), isoheptanoic acid, isooctanoic acid, isononanoic acid, isodecanoic acid, and mixtures thereof.

10. The method of clauses 1-9 wherein the formulated oil further comprises at least one dialkyl adipic acid ester having at least 20% of the total alkyl carbons in the form methyl groups, wherein the dialkyl adipic acid ester is selected from the group consisting of diisopropyl adipate, diisobutyl adipate, diisopentyl adipate, diisohexyl adipate, diisooctyl adipate, diisononyl adipate, diisodecyl adipate, and mixtures thereof.

11. The method of clauses 1-10 wherein the formulated oil further comprises one or more of an ionic detergent, a non-ionic detergent, dispersant, antiwear agent, viscosity index improver, antioxidant, pour point depressant, corrosion inhibitor, metal deactivator, seal compatibility additive, anti-foam agent, inhibitor, anti-rust additive, and friction modifier.

12. The method of clause 11, wherein the dispersant is one or more of a polymethacrylate or polyacrylate dispersant.

13. The method of clauses 1-12 wherein the at least one branched hydrocarbon or the at least one branched polyol ester, when 5% of which is added to isooctane, maintains at least 80% of the isooctane ignition or combustion delays as determined using the equipment and test conditions of ASTM D7668.

14. The method of clauses 1-13 wherein the high compression spark ignition engine has a compression ratio of at least 13.

15. The method of clauses 1-14 wherein the pre-ignition is low speed pre-ignition (LSPI).

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A method for preventing or reducing engine knock or pre-ignition in a high compression spark ignition engine lubricated with a lubricating oil by using as the lubricating oil a formulated oil including a Group I, Group II, Group III, Group IV, Group V base oil, or mixtures thereof, said formulated oil having a composition comprising at least one branched hydrocarbon having about 55% of the carbons in the form of methyl groups and a number average molecular weight of 282 to 370, wherein the at least one branched hydrocarbon is present in an amount of from 90 to 95 weight percent, based on the total weight of the formulated oil, and wherein the at least one branched hydrocarbon, when 1% of which is added to isooctane, maintains at least 100% of the isooctane ignition or combustion delays as determined using the equipment and test conditions of ASTM D7668.

2. The method of claim 1 wherein the at least one branched hydrocarbon has at least 20 carbon atoms.

3. The method of claim 1 wherein the at least one branched hydrocarbon comprises at least one poly(branched alkene) or at least one branched alkane or at least one branched alkene.

4. The method of claim 3 wherein the at least one poly(branched alkene) is derived from a C4 to C20 branched alkene.

5. The method of claim 3 wherein the at least one poly(branched alkene) comprises a hydrogenated polyisobutene base oil or an isoeicosane base oil.

6. The method of claim 1 wherein the at least one branched hydrocarbon has at least 20% of the carbons in the form of quaternary carbons.

7. The method of claim 1 wherein the formulated oil further comprises at least one dialkyl adipic acid ester having at least 20% of the total alkyl carbons in the form methyl groups.

8. The method of claim 7 wherein the dialkyl adipic acid ester is selected from the group consisting of diisopropyl adipate, diisobutyl adipate, diisopentyl adipate, diisohexyl adipate, diisooctyl adipate, diisononyl adipate, diisodecyl adipate, and mixtures thereof.

9. The method of claim 1 wherein the formulated oil further comprises at least one branched polyol ester having at least 35% of the carbons in the form of methyl groups.

10. The method of claim 1 wherein the lubricating oil further comprises one or more of an ionic detergent, a non-ionic detergent, dispersant, antiwear agent, viscosity index improver, antioxidant, pour point depressant, corrosion inhibitor, metal deactivator, seal compatibility additive, anti-foam agent, inhibitor, anti-rust additive, and friction modifier.

11. The method of claim 1 wherein the lubricating oil further comprises one or more of a polymethacrylate or polyacrylate dispersant.

12. The method of claim 1 wherein the high compression spark ignition engine has a compression ratio of at least 13.

13. The method of claim 1 wherein the high compression spark ignition engine is a super-charged engine or a turbo-charged engine.

14. The method of claim 1 wherein the pre-ignition is low speed pre-ignition (LSPI).

15. A method for preventing or reducing engine knock or pre-ignition in a high compression spark ignition engine lubricated with a lubricating oil by using as the lubricating oil a formulated oil including a Group I, Group II, Group III, Group IV, Group V base oil, or mixtures thereof, said formulated oil having a composition comprising at least one branched polyol ester, wherein the at least one branched polyol ester includes from 42% to 45% of the carbons in the form of methyl groups, wherein the at least one branched polyol ester is a mono-pentaerythritol ester of branched mono-carboxylic acids base oil or a di-pentaerythritol ester of branched mono-carboxylic acids base oil, wherein the branched mono-carboxylic acids are selected from the group consisting of 2,2-dimethyl propionic acid (neopentanoic acid), neoheptanoic acid, isohexanoic acid, 3,5,5-trimethyl hexanoic acid (TMH), isoheptanoic acid, isooctanoic acid, isononanoic acid, isodecanoic acid, and mixtures thereof, wherein the at least one branched polyol ester is present in an amount of from 90 to 95 weight percent, based on the total weight of the formulated oil, and wherein the at least one branched polyol ester, when 1% of which is added to isooctane, maintains at least 100% of the isooctane ignition or combustion delays as determined using the equipment and test conditions of ASTM D7668.

16. The method of claim 15 wherein the at least one branched polyol ester has at least 17 carbon atoms.

17. The method of claim 15 wherein the at least one branched polyol ester has at least 20% of the carbons in the form of quaternary carbons.

18. The method of claim 15 wherein the lubricating oil further comprises at least one dialkyl adipic acid ester having at least 20% of the total alkyl carbons in the form methyl groups.

19. The method of claim 18 wherein the dialkyl adipic acid ester is selected from the group consisting of diisopropyl adipate, diisobutyl adipate, diisopentyl adipate, diisohexyl adipate, diisooctyl adipate, diisononyl adipate, diisodecyl adipate, and mixtures thereof.

20. The method of claim 15 wherein the lubricating oil further comprises one or more of an ionic detergent, a non-ionic detergent, dispersant, antiwear agent, viscosity index improver, antioxidant, pour point depressant, corrosion inhibitor, metal deactivator, seal compatibility additive, anti-foam agent, inhibitor, anti-rust additive, and friction modifier.

21. The method of claim 15 wherein the lubricating oil further comprises one or more of a polymethacrylate or polyacrylate dispersant.

22. The method of claim 15 wherein the high compression spark ignition engine has a compression ratio of at least 13.

23. The method of claim 15 wherein the high compression spark ignition engine is a super-charged engine or a turbo-charged engine.

24. The method of claim 15 wherein the pre-ignition is low speed pre-ignition (LSPI).

* * * * *